US011787203B2

(12) United States Patent
Barrett

(10) Patent No.: US 11,787,203 B2
(45) Date of Patent: Oct. 17, 2023

(54) SYSTEM AND METHOD FOR HOLLOW VESSEL PRINTING

(71) Applicant: Ink Cups Now LLC, Danvers, MA (US)

(72) Inventor: Mark Barrett, Andover, MA (US)

(73) Assignee: INK CUPS NOW LLC., Danvers, MA (US)

( * ) Notice: Subject to any disclaimer, the term of this patent is extended or adjusted under 35 U.S.C. 154(b) by 0 days.

(21) Appl. No.: 17/472,133

(22) Filed: Sep. 10, 2021

(65) Prior Publication Data

US 2022/0072876 A1 Mar. 10, 2022

Related U.S. Application Data

(60) Provisional application No. 63/076,555, filed on Sep. 10, 2020.

(51) Int. Cl.
*B41J 11/00* (2006.01)
*B41J 3/407* (2006.01)

(52) U.S. Cl.
CPC ..... *B41J 11/00212* (2021.01); *B41J 3/40733* (2020.08)

(58) Field of Classification Search
CPC ..... B41J 11/00212; B41J 3/40733; B41J 11/00214
See application file for complete search history.

(56) References Cited

U.S. PATENT DOCUMENTS

| | | | |
|---|---|---|---|
| 8,926,047 | B2 | 1/2015 | LaCaze et al. |
| 9,327,492 | B2 | 5/2016 | Knott et al. |
| 10,710,377 | B2 | 7/2020 | Leo et al. |
| 10,710,378 | B1 | 7/2020 | Bullington et al. |
| 10,933,626 | B1 | 3/2021 | Bullington et al. |
| 10,946,639 | B1 | 3/2021 | Bullington et al. |
| 11,020,987 | B2 | 6/2021 | Bullington et al. |
| 11,141,994 | B2 | 10/2021 | Bullington et al. |
| 11,312,158 | B1 | 4/2022 | Bullington et al. |
| 11,338,593 | B1 | 5/2022 | Bullington et al. |
| 2010/0064912 | A1 | 3/2010 | Martinez, Jr. |
| 2015/0059600 | A1 | 3/2015 | Heidrich et al. |
| 2016/0028907 | A1 | 1/2016 | Kato |
| 2017/0066232 | A1 | 3/2017 | Litvinov et al. |
| 2017/0087872 | A1 | 3/2017 | Vella |
| 2018/0002212 | A1 | 1/2018 | Englram |

(Continued)

FOREIGN PATENT DOCUMENTS

| | | | |
|---|---|---|---|
| CN | 209903946 | U | 1/2020 |
| WO | 2018041422 | A1 | 3/2018 |

(Continued)

*Primary Examiner* — Bradley W Thies
(74) *Attorney, Agent, or Firm* — Lando & Anastasi, LLP

(57) ABSTRACT

A direct to shape (DTS) printer including a plurality of inkjet print head channels configured to deposit ink on an external surface of the vessel and a pinning lamp configured to provide light having a first peak power density to at least partially cure the ink deposited on the surface of the vessel is disclosed. The DTS printer can also include a rotary drive assembly configured to rotate the vessel relative to the plurality of inkjet print head channels, and a final curing lamp configured to provide light having a second peak power density to fully cure the ink deposited on the surface of the vessel.

16 Claims, 14 Drawing Sheets

(56) References Cited

U.S. PATENT DOCUMENTS

| | | | | |
|---|---|---|---|---|
| 2018/0022126 | A1 | 1/2018 | Miyashita et al. | |
| 2020/0316935 | A1 | 10/2020 | Bullington et al. | |
| 2021/0354482 | A1* | 11/2021 | Lindner ..... | B41F 23/0486 |

FOREIGN PATENT DOCUMENTS

| | | | |
|---|---|---|---|
| WO | 2019007979 | A1 | 1/2019 |
| WO | 2019178592 | A1 | 9/2019 |

* cited by examiner

SYSTEM AND METHOD FOR HOLLOW VESSEL PRINTING

CROSS REFERENCE TO RELATED APPLICATIONS

This application claims priority under 35 U.S.C. § 119(e) to U.S. Provisional Patent Application Ser. No. 63/076,555, titled "SYSTEM AND METHOD FOR HOLLOW VESSEL PRINTING," filed Sep. 10, 2020, which is incorporated by reference herein in its entirety for all purposes.

BACKGROUND

1. Field

Embodiments of the present disclosure relate generally to the printing of images on the exterior of axially symmetrical articles of manufacture using inkjet printing technology.

2. Discussion of Related Art

As is known in the art, several techniques can be utilized to print images on manufactured goods, such as drink containers. These containers are made of various materials, such as plastics, metals, and glass, and the traditional method for placing images on these containers, sometimes called "imaging" a container, is to print a label on a plastic or paper substrate and then affix the pre-printed label onto the container with adhesive.

In addition, manufacturers direct print onto the container surface, sometimes referred to as "direct-to-shape" (DTS) printing. There are two common mechanical configurations for DTS printers. In one configuration, the vessel to be printed is rotated and moved relative to fixed print heads. In an alternative configuration, the vessel is rotating but fixed axially while a carriage comprised of a plurality of print heads moves along the axial direction of the vessel. However, direct printing on containers poses many challenges. One challenge is that the containers themselves are made of materials that are difficult to image. Inks of special chemical blends and additives must be used, sometimes in the presence of active drying or hardening processes such as fast-curing using ultra-violet (UV) radiation. Further, container shapes are fixed, and a printing process must take into account the irregular and varied shapes of the containers that are to be printed. Also, while curing ink printed on the surface of a transparent object, UV light from the curing lamp(s) can travel through the object and damage or clog the print heads.

SUMMARY

An aspect of the present disclosure is directed to A direct to shape (DTS) printer configured to print on a surface of a vessel. The DTS printer includes a plurality of inkjet print head channels configured to deposit ink on the surface of the vessel, a rotary drive assembly configured to rotate the vessel relative to the plurality of inkjet print head channels, and at least one pinning lamp configured to provide light having a first peak power density to sufficiently cure the ink deposited on the surface of the vessel. The DTS printer also includes a final curing lamp configured to provide light having a second peak power density to fully cure the ink deposited on the surface of the vessel.

In an embodiment, the second peak power density is greater than the first peak power density.

At least one aspect of the present disclosure is directed to a direct to shape (DTS) printer configured to print on a surface of a vessel. The DTS printer includes a plurality of inkjet print heads configured to deposit ink on the surface of the vessel, a rotary drive assembly configured to rotate the vessel relative to the plurality of inkjet print heads, at least one pinning lamp configured to provide light having a first peak power density to sufficiently (at least partially) or fully cure the ink deposited on the surface of the vessel, and a final curing lamp configured to provide light having a second peak power density to further cure the ink deposited on the surface of the vessel, the second peak power density being greater than the first peak power density.

An embodiment provides that the final curing lamp is located such that its radiation doesn't reach any of the print heads or such that the final curing lamp is not enabled at a time that light from the curing lamp can expose the print heads (if moving axially with the vessel) so that the print heads are not exposed to the final curing light.

In one embodiment, the DTS printer includes a linear drive assembly configured to move the vessel along an axis adjacent to the plurality of inkjet print heads. In some embodiments, the at least one pinning lamp is configured to sufficiently (at least partially) cure the ink deposited on the surface of the vessel. In certain embodiments, the curing lamp is configured to be off until the vessel is moved away from the plurality of inkjet print heads. In various embodiments, the at least one pinning lamp is positioned with respect to the plurality of inkjet print heads such that the light provided by the at least one pinning lamp is reflected off the surface of the vessel away from the plurality of inkjet print heads.

In some embodiments, the at least one pinning lamp is positioned to provide light to the surface of the vessel at an incident angle that is less than a critical angle corresponding to a material of the vessel. In certain embodiments, the DTS printer includes a light trap configured to absorb or dampen the light reflected off the surface of the vessel. In one embodiment, the at least one pinning lamp is configured to provide the light having the first peak power density at a substantially constant level over an operational distance range. In various embodiments, the position of the at least one pinning lamp is configured to be adjusted such that a maximum working distance between the at least one pinning lamp and the surface of the vessel is within the operational distance range of the at least one pinning lamp, and wherein the maximum working distance corresponds to the position of the at least one pinning lamp and a shape of the vessel. In some embodiments, the curing lamp is positioned beneath the vessel. In certain embodiments, the DTS printer is configured to print a vessel that is hollow and transparent.

Embodiments of the system include a UV sensor that is located near the print head nozzles that senses the amount of light exposure from the at least one pinning lamp and that provides the sensed amount of light information to a controller that is used to control the amount of light output from the at least one pinning lamp to ensure the alignment of the at least one pinning lamp, in conjunction with the vessel geometry, and to ensure that the level of emitted light does not result in radiation levels high enough to cure ink in the print head nozzles as this can damage the head or degrade image quality.

An aspect of the disclosure is directed to method of printing on a surface of a vessel. The method comprises rotating the vessel relative to a plurality of inkjet print head channels using a rotary drive assembly, depositing ink from the plurality of inkjet print head channels on the surface of the vessel, and providing light having a first peak power density from at least one pinning lamp to sufficiently cure the ink deposited on the surface of the vessel. The method also includes providing light having a second peak power density from a curing lamp to fully cure the ink deposited on the surface of the vessel.

Embodiments include providing light from curing lamp at the second peak power density that is greater than the light provided by the at least one pinning lamp at the first peak power density.

An aspect of the present disclosure is directed to a method of printing on the surface of a vessel including rotating the vessel relative to a plurality of inkjet print heads using a rotary drive assembly, depositing ink from a plurality of inkjet print heads on the surface of the vessel, providing light having a first peak power density from at least one pinning lamp to sufficiently (at least partially) or fully cure the ink deposited on the surface of the vessel, and providing light having a second peak power density from a curing lamp to fully cure the ink deposited on the surface of the vessel, the second peak power density being greater than the first peak power density.

In one embodiment, the method includes moving the vessel along an axis adjacent to the plurality of inkjet print heads using a linear drive assembly. In some embodiments, the curing with the at least one pinning lamp comprises sufficiently (at least partially) or fully curing the ink deposited on the surface of the vessel. In certain embodiments, the method includes keeping the curing lamp turned off until the vessel is moved away from the plurality of inkjet print heads. In various embodiments, adjusting a position of the at least one pinning lamp such that the light provided by the at least one pinning lamp is reflected off the surface of the vessel away from the plurality of inkjet print heads.

An embodiment includes two pinning lamps which can be in series or in parallel to perform sufficient (at least partial) curing of ink on the vessel. One advantage of having two or more pinning lamps is that it provides for each pinning lamp to be configured and controlled separately to provide less peak output power than a single pinning lamp arrangement, which provides for providing the total dose of light (power*time) to sufficiently (at least partially) cure the ink while also providing for less light being provided to the print heads so as to avoid any curing ink in the print heads.

An embodiment includes multiple pinning lamps mechanically aligned in parallel. With multiple pinning lamps, each pinning lamp is configured and controlled to be controlled separately to provide lower irradiance power than a single pinning lamp arrangement, which provides for providing the total dose of light (power*time) to sufficiently (at least partially) cure the ink while also providing for less light being provided to the print heads so as to avoid any curing ink in the print heads.

In some embodiments, adjusting the position of the at least one pinning lamp further includes positioning the at least one pinning lamp to provide light to the surface of the vessel at an incident angle that is less than a critical angle corresponding to a material of the vessel. In various embodiments, the method includes providing the light having the first peak power density at a substantially constant level over an operational distance range. In one embodiment, the method includes positioning the at least one pinning lamp such that a maximum working distance between the at least one pinning lamp and the surface of the vessel is within the operational distance range of the at least one pinning lamp, and wherein the maximum working distance corresponds to the position of the at least one pinning lamp and a shape of the vessel. In certain embodiments, the method includes printing on a vessel that is hollow and transparent.

An aspect of the disclosure is directed to a direct to shape (DTS) printer configured to print on a surface of a vessel. The DTS printer includes a plurality of inkjet print head channels configured to deposit ink on the surface of the vessel, a rotary drive assembly configured to rotate the vessel relative to the plurality of inkjet print head channels, and a pinning means for sufficiently curing the ink deposited on the surface of the vessel. The DTS printer also includes a curing lamp positioned orthogonal to the vessel and configured to provide light to fully cure the ink deposited on the surface of the vessel.

Some embodiments include a means for keeping the curing lamp off until the vessel is moved away from the plurality of inkjet print head channels.

In some embodiments, the pinning means includes means for providing light for sufficiently curing the ink at a first power density and the light provided by the curing lamp at the second peak power density is greater than the light provided by the first peak power density.

In some embodiments, the DTS printer further comprises a linear drive assembly configured to move the vessel along an axis adjacent to the plurality of inkjet print head channels.

In some embodiments, the DTS printer further comprises a rotary drive assembly that is a fixed rotating assembly and further comprising a print head carriage assembly that moves along the axis of the vessel so as to print the image on the vessel.

In some embodiments, the DTS printer further comprises means for moving the pinning lamp with the print head carriage assembly to irradiate the vessel to sufficiently cure an image printed on the vessel.

In some embodiments, the means for sufficiently curing comprises sufficiently curing the ink on the vessel such that the printed image on the vessel can be coated with a varnish without affecting the printed image.

In some embodiments, the means for sufficiently curing comprises fully curing the ink deposited on the surface of the vessel.

In some embodiments, the DTS printer further comprises means for sensing an amount of light exposure near the print head channels and controlling the amount of light output from the means for sufficiently curing to ensure that the level of emitted light does not result in radiation levels high enough to cure ink in the print head channels.

In some embodiments, the DTS printer further comprises means for adjusting a position of the means for sufficiently curing such that the light provided is reflected off the surface of the vessel away from the plurality of inkjet print head channels.

In some embodiments, the means for positioning further includes positioning the means for sufficiently curing to provide light to the surface of the vessel at an incident angle that is less than a critical angle corresponding to a material of the vessel.

In some embodiments, the means for sufficiently curing further comprising means for providing the light having the first peak power density at a substantially constant level over an operational distance range.

In some embodiments, the DTS printer further comprises means for positioning the means for sufficiently curing such that a maximum working distance between the means for sufficiently curing and the surface of the vessel is within an operational distance range of the means for sufficiently curing.

Another aspect of the present disclosure is directed to a direct to shape (DTS) printer configured to print on a surface of a vessel. The DTS printer includes a plurality of inkjet print heads configured to deposit ink on the surface of the vessel, a rotary drive assembly configured to rotate the vessel relative to the plurality of inkjet print heads, a curing lamp positioned beneath the vessel and configured to provide light to fully cure the ink deposited on the surface of the vessel, and means for pinning the ink deposited on the surface of the vessel and for keeping the curing lamp off until the vessel is moved away from the plurality of inkjet print heads.

In one embodiment, the DTS printer includes a linear drive assembly configured to move the vessel along an axis adjacent to the plurality of inkjet print heads. With this arrangement, at least one pinning lamp is disposed in a fixed location and configured and arranged to irradiate the vessel to sufficiently (at least partially cure) an image printed on the vessel. An alternate embodiment includes a fixed rotating vessel with a print head carriage that moves along the axis of the vessel. With this arrangement, the at least one pinning lamp is located and arranged to move with the ink jet carriage to irradiate the vessel to sufficiently (at least partially cure) an image printed on the vessel. With this arrangement, the final curing lamp is fixed relative to the printed surface.

In some embodiments, the means for pinning the ink deposited on the surface of the vessel includes means for sufficiently (at least partially) or fully curing the ink while preventing the plurality of inkjet print heads from being damaged.

Another aspect of the present disclosure is directed to a direct to shape (DTS) printer configured to print on a surface of a vessel. The DTS printer includes a plurality of inkjet print heads configured to deposit ink on the surface of the vessel, a linear drive assembly configured to move the vessel along an axis adjacent to the plurality of inkjet print heads, a rotary drive assembly configured to rotate the vessel relative to the plurality of inkjet print heads, at least one pinning lamp configured to provide light having a first peak power density to sufficiently (at least partially) or fully cure the ink deposited on the surface of the vessel, and a curing lamp configured to provide light having a second peak power density to fully cure the ink deposited on the surface of the vessel, the second peak power density being greater than the first peak power density.

In one embodiment, the at least one pinning lamp is configured to sufficiently (at least partially) or fully cure the ink deposited on the surface of the vessel. In some embodiments, the final curing lamp is configured to be off until the vessel is moved away from the plurality of inkjet print heads. In some embodiments, the final curing lamp is located such that its radiation doesn't reach any of the print heads. In some embodiments, the final curing lamp is not enabled at a time that light from the curing lamp can expose the print heads so that the print heads are not exposed to the final curing light.

In various embodiments, the at least one pinning lamp is positioned with respect to the plurality of inkjet print heads such that the light provided by the at least one pinning lamp is reflected off the surface of the vessel away from the plurality of inkjet print heads. In certain embodiments, the at least one pinning lamp is positioned to provide light to the surface of the vessel at an incident angle that is less than a critical angle corresponding to a material of the vessel.

In some embodiments, the DTS printer includes a light trap configured to absorb or dampen the light reflected off the surface of the vessel. In certain embodiments, the at least one pinning lamp is configured to provide the light having the first peak power density at a substantially constant level over an operational distance range. In one embodiment, the position of the at least one pinning lamp is configured to be adjusted such that a maximum working distance between the at least one pinning lamp and the surface of the vessel is within the operational distance range of the at least one pinning lamp, and wherein the maximum working distance corresponds to the position of the at least one pinning lamp and a shape of the vessel. In various embodiments, the curing lamp is positioned beneath the vessel. In one embodiment, the DTS printer is configured to print a vessel that is hollow and transparent.

Another aspect of the disclosure is directed to a method of printing on the surface of a vessel including moving the vessel along an axis adjacent to a plurality of inkjet print heads using a linear drive assembly, rotating the vessel relative to the plurality of inkjet print heads using a rotary drive assembly, depositing ink from a plurality of inkjet print heads on the surface of the vessel, providing light having a first peak power density from at least one pinning lamp to cure the ink deposited on the surface of the vessel, and providing light having a second peak power density from a curing lamp to fully cure the ink deposited on the surface of the vessel, the second peak power density being greater than the first peak power density.

In some embodiments, the curing with at least one pinning lamp assembly includes sufficiently (at least partially) or fully curing the ink deposited on the surface of the vessel. In one embodiment, the method includes keeping the curing lamp turned off until the vessel is moved away from the plurality of inkjet print heads. In various embodiments, the method includes adjusting a position of the at least one pinning lamp such that the light provided by the at least one pinning lamp is reflected off the surface of the vessel away from the plurality of inkjet print heads. In certain embodiments, adjusting the position of the at least one pinning lamp further includes positioning the at least one pinning lamp to provide light to the surface of the vessel at an incident angle that is less than a critical angle corresponding to a material of the vessel.

In one embodiment, the method includes providing the light having the first peak power density at a substantially constant level over an operational distance range. In some embodiments, the method includes positioning the at least one pinning lamp such that a maximum working distance between the at least one pinning lamp and the surface of the vessel is within the operational distance range of the at least one pinning lamp, and wherein the maximum working distance corresponds to the position of the at least one pinning lamp and a shape of the vessel. In certain embodiments, the method includes printing on a vessel that is hollow and transparent. In some embodiments, the method includes aligning an axis of the at least one pinning lamp with a rotational axis of a tapered vessel to ensure a sufficient amount of radiation is provided to the vessel.

Another aspect of the disclosure is directed to a direct to shape (DTS) printer configured to print on a surface of a vessel. The DTS printer includes a plurality of inkjet print heads configured to deposit ink on the surface of the vessel, a linear drive assembly configured to move the vessel along an axis adjacent to the plurality of inkjet print heads, a rotary drive assembly configured to rotate the vessel relative to the plurality of inkjet print heads, a curing lamp positioned beneath the vessel and configured to provide light to fully cure the ink deposited on the surface of the vessel, and means for pinning the ink deposited on the surface of the vessel and for keeping the curing lamp off until the vessel is moved away from the plurality of inkjet print heads.

In one embodiment, the means for pinning the ink deposited on the surface of the vessel includes means for sufficiently (at least partially) or fully curing the ink while preventing the plurality of inkjet print heads from being damaged by the curing radiation.

Another aspect of the disclosure is directed to a direct to shape (DTS) printer configured to print on a surface of a vessel. The DTS printer includes a plurality of inkjet print heads configured to deposit ink on the surface of the vessel, a linear drive assembly configured to move the vessel along an axis adjacent to the plurality of inkjet print heads, a rotary drive assembly configured to rotate the vessel relative to the plurality of inkjet print heads, at least one pinning lamp configured to provide light having a first peak power density to sufficiently (at least partially) or fully cure the ink deposited on the surface of the vessel, and a curing lamp positioned beneath the vessel configured to provide light having a second peak power density to fully cure the ink deposited on the surface of the vessel, the second peak power density being greater than the first peak power density.

In some embodiments, the at least one pinning lamp is configured to sufficiently (at least partially) or fully cure the ink deposited on the surface of the vessel such that the curing lamp can remain turned off until the vessel is moved away from the plurality of inkjet print heads. In one embodiment, the at least one pinning lamp assembly is positioned with respect to the plurality of inkjet print heads such that the light provided by the at least one pinning lamp is reflected off the surface of the vessel away from the plurality of inkjet print heads. In certain embodiments, the at least one pinning lamp is positioned to provide light to the surface of the vessel at an incident angle that is less than a critical angle corresponding to a material of the vessel. In some embodiments, the final curing lamp is located such that its radiation doesn't reach any of the print heads or such that the final curing lamp is not enabled at a time that light from the curing lamp can expose the print heads so that the print heads are not exposed to the final curing light. In one embodiment, the DTS printer includes a light trap configured to absorb or dampen the light reflected off the surface of the vessel. In various embodiments, the at least one pinning lamp is configured to provide the light having the first peak power density at a substantially constant level over an operational distance range. In certain embodiments, the position of the at least one pinning lamp is adjusted such that a maximum working distance between the at least one pinning lamp and the surface of the vessel is within the operational distance range of the at least one pinning lamp. In some embodiments, the maximum working distance corresponds to the position of the at least one pinning lamp and a shape of the vessel. In one embodiment, the vessel is hollow and transparent.

Another aspect of the present disclosure is directed to a method of printing on the surface of a vessel including moving the vessel along an axis adjacent to a plurality of inkjet print heads using a linear drive assembly, rotating the vessel relative to the plurality of inkjet print heads using a rotary drive assembly, depositing ink from a plurality of inkjet print heads on the surface of the vessel, providing light having a first peak power density from at least one pinning lamp to sufficiently (at least partially) or fully cure the ink deposited on the surface of the vessel, and providing light having a second peak power density from a curing lamp positioned beneath the vessel to fully cure the ink deposited on the surface of the vessel, the second peak power density being greater than the first peak power density.

In one embodiment, the at least one pinning lamp is configured to sufficiently (at least partially) or fully cure the ink deposited on the surface of the vessel allowing the curing lamp to remain turned off until the vessel is moved away from the plurality of inkjet print heads. In some embodiments, the method includes adjusting a position of the at least one pinning lamp such that the light provided by the at least one pinning lamp is reflected off the surface of the vessel away from the plurality of inkjet print heads. In certain embodiments, adjusting the position of the at least one pinning lamp further includes positioning the at least one pinning lamp to provide light to the surface of the vessel at an incident angle that is less than a critical angle corresponding to a material of the vessel. In various embodiments, the at least one pinning lamp is configured to provide the light having the first peak power density at a substantially constant level over an operational distance range.

In some embodiments, adjusting the position of the at least one pinning lamp assembly further includes positioning the at least one pinning lamp such that a maximum working distance between the at least one pinning lamp and the surface of the vessel is within the operational distance range of the at least one pinning lamp. In certain embodiments, the maximum working distance corresponds to the position of the at least one pinning lamp and a shape of the vessel. In various embodiments, the vessel is hollow and transparent.

Another aspect of the present disclosure is directed to a direct to shape (DTS) printer configured to print on a surface of a vessel. The DTS printer includes a plurality of inkjet print heads configured to deposit ink on the surface of the vessel, a linear drive assembly configured to move the vessel along an axis adjacent to the plurality of inkjet print heads, a rotary drive assembly configured to rotate the vessel relative to the plurality of inkjet print heads, a curing lamp positioned beneath the vessel and configured to provide light to fully cure the ink deposited on the surface of the vessel, and means for pinning the ink deposited on the surface of the vessel allowing the main curing lamp to remain turned off until the vessel is moved away from the plurality of inkjet print heads.

Additional aspects and embodiments of the disclosure include that the various pinning lamp assemblies can be applied to machines providing multiple, in parallel, imaging tunnels comprising two or more printing paths.

In one embodiment, pinning the ink deposited on the surface of the vessel includes sufficiently (at least partially) or fully curing the ink while preventing the plurality of inkjet print heads from being damaged. In some embodiments, the vessel is hollow and transparent.

BRIEF DESCRIPTION OF THE DRAWINGS

Various aspects of at least one embodiment are discussed below with reference to the accompanying figures, which are not intended to be drawn to scale. The figures are included to provide illustration and a further understanding of the various aspects and embodiments and are incorporated in and constitute a part of this specification, but are not intended as a definition of the limits of the disclosure. In the figures, each identical or nearly identical component that is illustrated in various figures is represented by a like numeral. For purposes of clarity, not every component may be labeled in every figure. In the figures.

DETAILED DESCRIPTION

Figure 1:
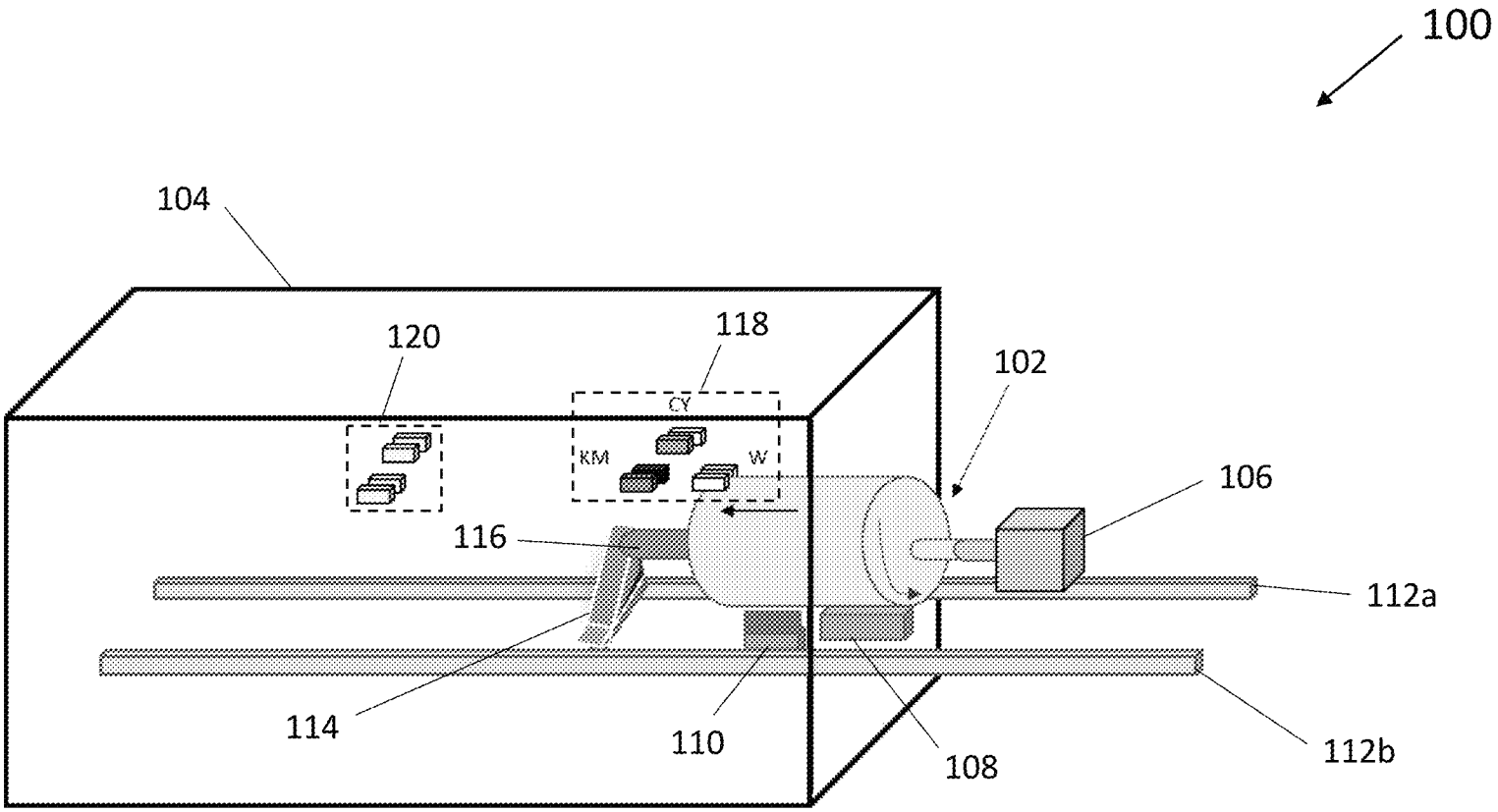
FIG. 1 is a schematic diagram illustrating one example of a single tunnel direct-to-shape (DTS) printer in accordance with aspects described herein.

It is to be appreciated that embodiments of the methods and apparatuses discussed herein are not limited in application to the details of construction and the arrangement of components set forth in the following description or illustrated in the accompanying drawings. The methods and apparatuses are capable of implementation in other embodiments and of being practiced or of being carried out in various ways. Examples of specific implementations are provided herein for illustrative purposes only and are not intended to be limiting. Also, the phraseology and terminology used herein is for the purpose of description and should not be regarded as limiting. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms.

As discussed above, several techniques can be utilized to print images on manufactured goods (e.g., containers), such as plastics, metals, and glassware. The traditional method for placing images on these containers, sometimes called "imaging" a container, is to print a label on a plastic or paper substrate and then affix the pre-printed label onto the container with adhesive.

In addition, manufactures direct print onto the container surface, sometime referred to as "direct-to-shape" (DTS) printing. Inkjet DTS printing has over time become a preferred method for DTS printing, especially for package printing. Inkjet printing utilizes a digital printhead to print full color customized designs in one or multiple imaging passes and may be applied directly to the substrate surface of the object. The transfer occurs by propelling droplets of ink directly onto the substrate medium. The ink delivery mechanism is called the "printhead," and is controlled by a digital image held by a computer system. However, the design of printheads in an inkjet system varies greatly.

The benefits of inkjet printing in DTS applications have driven a recent preference to use inkjet systems in product manufacturing lines. For example, inkjet printing requires less set-up time and allows for faster print and cure times. Inkjet printing also is configurable to allow printing on multiple items at once. Moreover, print jobs do not require fixed setup time and costs, such as the generation of screens or the installation of plates. Another advantage of inkjet printing is the ability to change graphic images quickly to adjust for printing results. Imaging software allows for the importation of graphics instantly. Hence, the flexibility of image alteration on a job-by-job basis is a distinct advantage.

However, direct printing on containers poses many challenges. One challenge is that the containers themselves are made of materials that are difficult to image. Inks of special chemical blends and additives must be used, sometimes in the presence of active drying or hardening processes such as fast-curing using ultra-violet (UV) radiation. Further, container shapes are fixed, and a printing process must take into account the irregular and varied shapes of the containers that are to be printed. Such challenging print surfaces comprise a good many products, such as drink cans and bottles, cups, coffee tumblers to name just a few.

One type of inkjet system is specialized to print on the surface of cylindrical objects and are called "digital cylindrical presses." For example, Ink Cups Now Corporation offers the Helix line of DTS printers. These printers use rotatable tool (sometimes a mandrel holding the inner wall of the cup or more typically, two tools that capture each end of the vessel) to hold an object and rotate the object next to an inkjet printhead as the printhead jets ink onto the surface of the cylindrical object. Such DTS printers can be configured to print on a variety of cylindrical objects including transparent objects such as spirit bottles, glassware, drinkware, and candle holders. The structure and operation of standard cylindrical DTS printing systems are fairly well understood in the printing industry and disclosed in, for example, representative U.S. Pat. Nos. 6,918,641B2 and 7,967,405B2.

FIG. 1 illustrates a schematic diagram of a DTS printer 100 in accordance with aspects described herein. In one example, the DTS printer 100 is a digital cylindrical DTS printing system configured to print on the surface of a vessel 102. As shown, the DTS printer 100 includes a carriage tunnel 104, a rotary drive assembly 106, a linear drive assembly 108, a curing lamp 110, a first carriage rail 112*a*, a second carriage rail 112*b*, a carriage rail assembly 114, a nose cone or tail stock 116, and inkjet print heads 118. It is to be appreciated that a print head channel can include on or more inkjet print heads of one or more colors. It is also to be understood that herein the terms print heads and print head channels are used interchangeably, unless specifically noted or claimed to be a print head channel. In some examples, the DTS printer 100 includes a one or more varnish print heads 120. A UV sensor is in a pocket next to a print head to sense when too much energy is reaching the print heads. In particular, the UV sensor that is located near the print head nozzles is configured to sense the amount of light exposure from at least one pinning lamp, pinning lamps or a final curing lamp and to provide the sensed amount of light information to a controller that is used to control the amount of light output from the pinning lamp(s) to ensure any or all of alignment of the pinning lamp(s), and to ensure that the level of emitted light does not result in radiation levels high enough to cure ink in the print head nozzles as this can damage the head or degrade image quality.

The DTS printer 100 machine is a good example of an industry standard cylindrical DTS printing system. The DTS printer 100 is a stand-alone machine that performs non-contact printing of images on generally cylindrical objects (e.g., the vessel 102); however, in some examples, the DTS printer 100 can be configured to print images on different shaped objects. In some examples, the vessel 102 is a hollow cylindrical object or hollow partially cylindrical objects for example, a can or bottle, tapered drinkware, or curved objects with a circular cross section.

The vessel 102 is hand or robotically loaded and secured either by vacuum (not shown) on a mandrel 116 or by friction after both ends of the vessel are captured to prevent slippage, which assembly is attached to the carriage rail assembly 114 to linearly position the vessel 102 beneath the inkjet print heads 118. The vessel 102 is rotated below and in front of the inkjet print heads 118 while ink is deposited to the vessel 102 to produce a desired printed design on the vessel 102. The jetted ink on the vessel 102 is cured before printing more ink dots on the previous layer to avoid the ink from spreading on the vessel surface. The ink is either sufficiently (at least partially) or fully cured immediately after printing by exposing the ink to the curing lamp 110. In one example, the curing lamp 110 is an energy-emitting device, such as a UV light emitter, positioned directly beneath (positioned 180 degrees from the inkjet print heads 118) the vessel 102. Typical light emitters are LED arrays under 400 nm or mercury lamps.

The carriage rail assembly 114 is attached to the first and second carriage rails 112*a*, 112*b* and the linear drive assembly 108 is operated to slide the carriage rail assembly 114 (i.e., the vessel 102) along the first and second carriage rails 112*a*, 112*b*. The linear drive assembly 108 linearly advances the vessel 102 in a position adjacent to the inkjet print heads 118 such that a first portion of the vessel 102 may be printed if the vessel length is longer than the length of the print heads.

The vessel 102 is rotated via the tooling 116 and the rotary drive assembly 106 while the inkjet print heads 118 deposit ink from a supply of ink located above the vessel 102 (not shown). Simultaneously the curing lamp 110 below the vessel 102 either sufficiently (at least partially) or completely cures the ink. The linear drive assembly 108 then continues to advance the vessel 102 further such that the entire length of the vessel 102 is printed. In certain examples, the continuous advancement of the vessel 102 may not be necessary if the inkjet print heads 118 are longer than the image desired to be printed on the vessel 102.

In some examples, the image itself comprises a digital image. A print engine running on the DTS printer 100 or an associated computer system controls the delivery of ink onto the vessel 102 via the inkjet print heads 118 as the object is moved past the inkjet print heads 118 in a digitally controlled manner. In one example, the inkjet print heads 118 correspond to a set of CMYKW (Cyan Magenta Yellow Black and White) print channels. However, in other examples, the inkjet print heads 118 may correspond to a different color model (e.g., RGB) or the CMYKW might have additional colors (light cyan, light black, and light magenta to improve skin tones or orange, violet, and green to expand the color gamut printed. In certain examples, once the desired printed design has been deposited on the vessel 102, varnish print heads 120 may apply a coating of varnish to the vessel 102 for either a shiny finish or to build up a 3D effect to the print.

Figure 2:
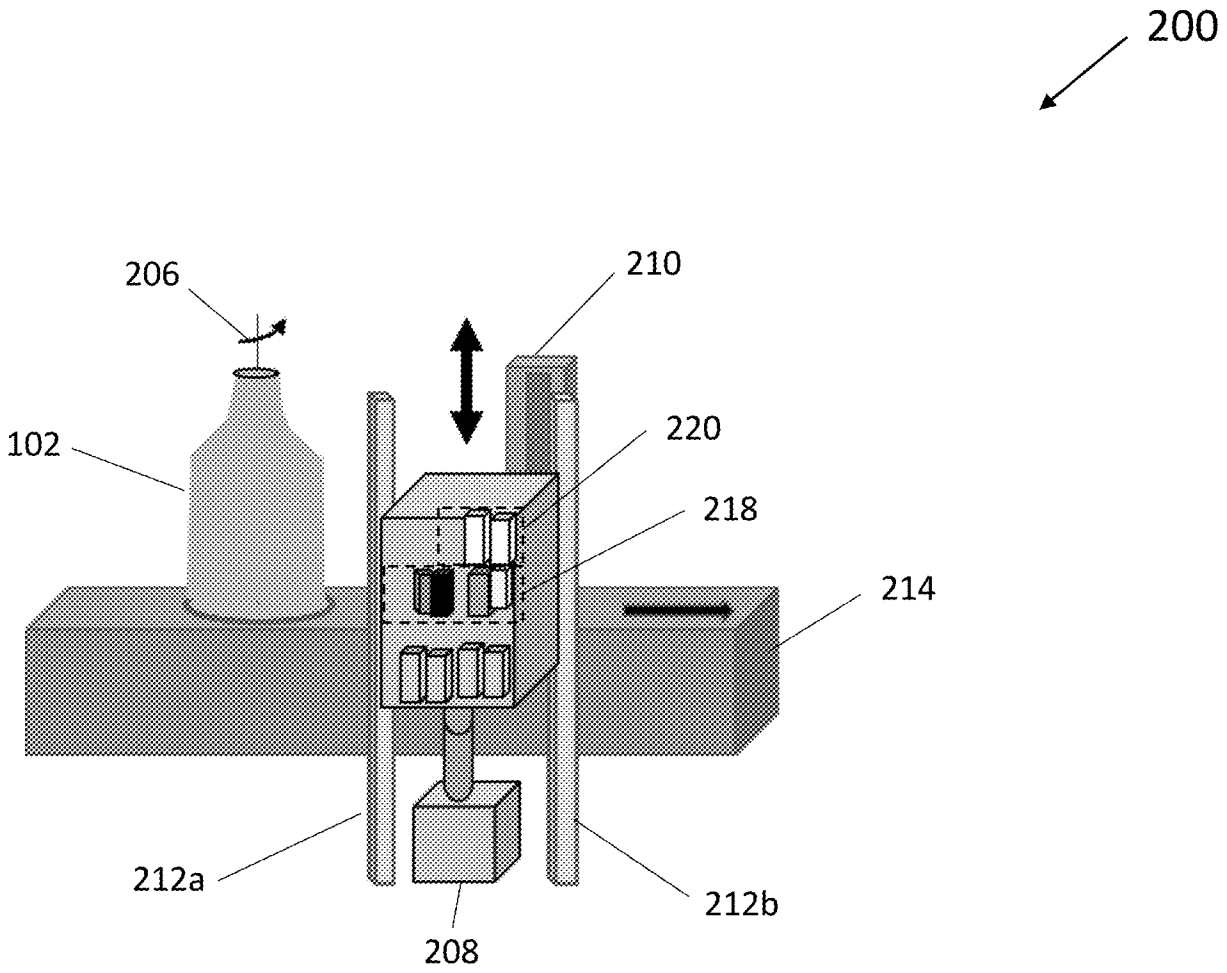
FIG. 2 is a schematic diagram illustrating a direct-to-shape (DTS) printer in accordance with aspects described herein.

In certain examples, alternative DTS printer configurations may be used to print on the surface of various objects (i.e., the vessel 102). For example, FIG. 2 illustrates a schematic diagram of a DTS printer 200 in accordance with aspects described herein. Similar to the DTS printer 100 of FIG. 1, the DTS printer 200 is a digital cylindrical DTS printing system configured to print on the surface of the vessel 102 but instead of the vessel moving axially, an ink jet carriage will move along the vessel's rotational axis. As shown, the DTS printer 200 includes a rotary drive assembly 206, a carriage drive assembly 208, a curing lamp 210, a first carriage rail 212*a*, a second carriage rail 212*b*, a linear conveyer assembly 214, and inkjet print heads 218. In some examples, the DTS printer 200 includes one or more varnish print heads 220.

The DTS printer 200 is a stand-alone machine that performs non-contact printing of images on generally cylindrical objects (e.g., the vessel 102); however, in some examples, the DTS printer 200 can be configured to print images on different shaped objects. In some examples, the vessel 102 is a hollow cylindrical object or hollow partially cylindrical objects for example, a can or bottle.

The vessel 102 is hand-loaded on the linear conveyer assembly 214 to linearly position the vessel 102 relative to the inkjet print heads 218. In some examples, the vessel 102 may be secured using a vacuum (not shown) to prevent slippage. The vessel 102 is rotated in front of the inkjet print heads 218 while ink is deposited to the vessel 102 to produce a desired printed design on the vessel 102. The jetted ink on the vessel 102 is cured before printing more ink dots on the previous layer to avoid the ink from spreading on the vessel surface. The ink is either sufficiently (at least partially) or fully cured immediately after printing by exposing the ink to the curing lamp 210. In one example, the curing lamp 210 is an energy-emitting device, such as a UV light emitter.

The inkjet print heads 218 are attached to the first and second carriage rails 112*a*, 112*b* and the carriage drive assembly 208 is operated to slide the inkjet print heads 218 along the first and second carriage rails 212*a*, 212*b*. The carriage drive assembly 208 positions the inkjet print heads 218 adjacent to the vessel 102 such that the vessel 102 may be printed.

The vessel 102 is rotated via the rotary drive assembly 206 while the inkjet print heads 218 deposit ink from a supply of ink (not shown). Simultaneously the curing lamp 110 either sufficiently (at least partially) or completely cures the ink. The linear conveyor assembly 214 then continues to advance the vessel 102 further such that the entire vessel 102 is printed. In certain examples, the continuous advancement of the vessel 102 may not be necessary if the inkjet print heads 218 are longer than the image desired to be printed on the vessel 102.

In some examples, the image itself comprises a digital image. A print engine running on the DTS printer 200 or an associated computer system controls the delivery of ink onto the vessel 202 via the inkjet print heads 218 as the object is moved past the inkjet print heads 218 in a digitally controlled manner. In one example, the inkjet print heads 218 correspond to a set of CMYK (Cyan Magenta Yellow Black) print heads; however, in other examples, the inkjet print heads 218 may correspond to a different color model (e.g., RGB). In certain examples, once the desired printed design has been deposited on the vessel 102, the varnish print heads 220 may apply a coating of varnish to the vessel 102.

As described above, the DTS printers 100, 200 can provide printing of objects having a circular cross section while varying in diameter, including transparent objects such as spirit bottles, glassware, drinkware, and candle holders (i.e., vessel 102). However, an issue with printing transparent objects is that the UV light from the curing lamps 110, 210 must be kept away from the inkjet print heads to prevent ink from partially or fully curing within the print head nozzles.

Figure 3A:
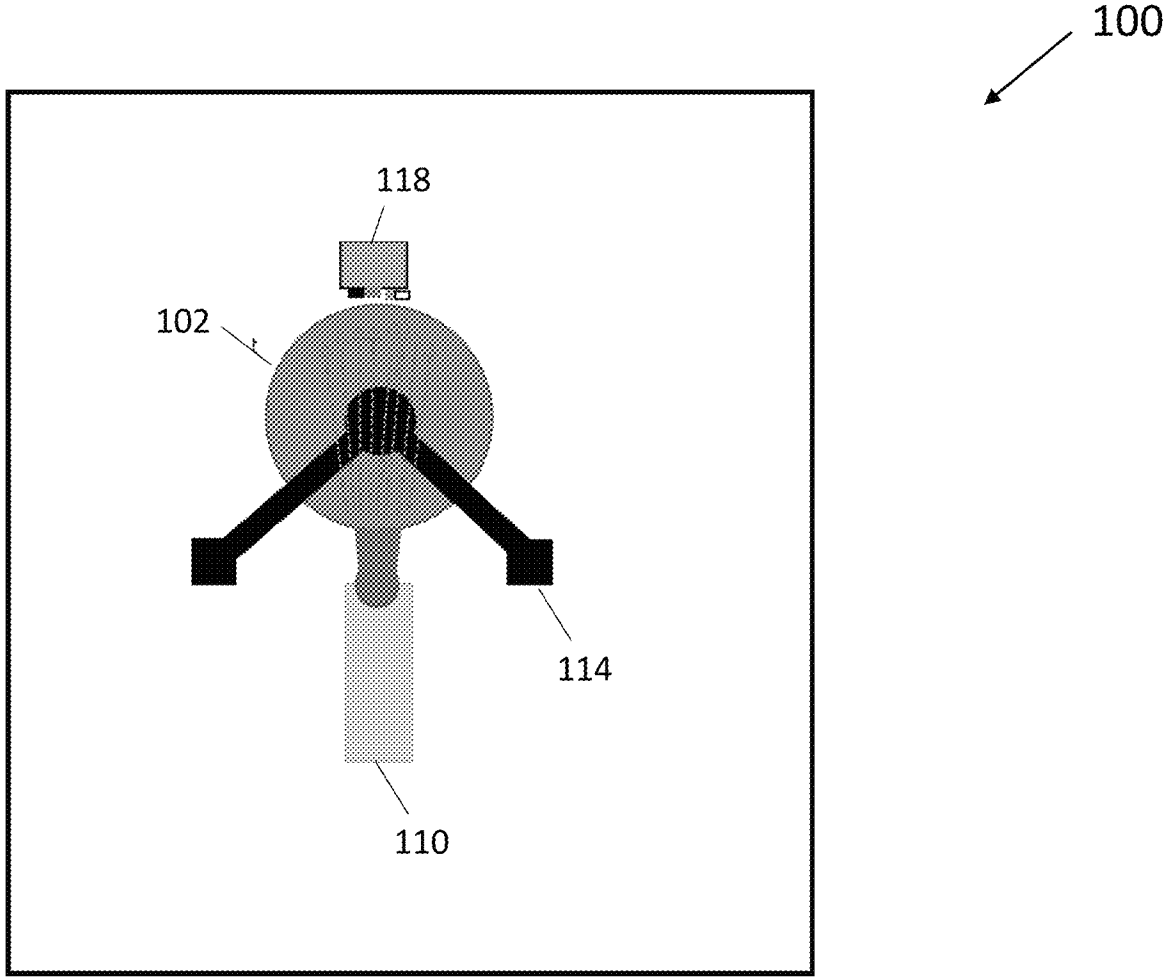
FIG. 3A is diagram illustrating one example of the final curing lamp positioning a DTS printer curing ink printed on the surface of a vessel in accordance with aspects described herein.

As shown in FIG. 3A, while curing ink printed on the surface of a transparent object (i.e., the vessel 102), UV light from the curing lamp 110 can travel through the vessel 102 and reach one or more of the inkjet print heads 118. As a result, ink may be cured within one or more of the print heads, blocking the nozzles of the print heads. In particular, if the nozzles get clogged, image quality will degrade or worse the inkjet print heads 118 can be damaged or ruined.

Figure 3B:
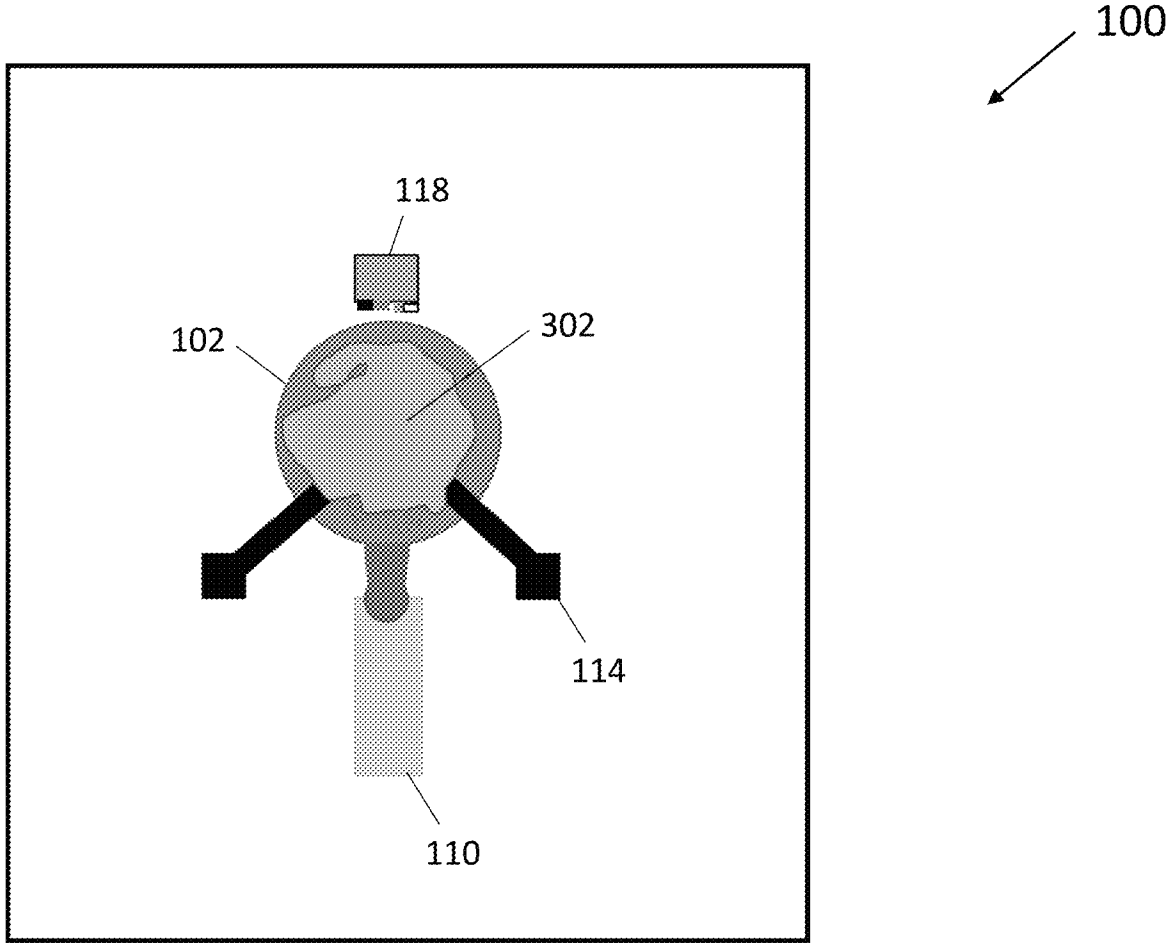
FIG. 3B is diagram illustrating of a DTS printer curing ink printed on the surface of a vessel in accordance with aspects described herein where the vessel is stuffed to block the curing radiation from reaching the ink jet heads.

In some cases, light blocking and/or scattering materials can be inserted or stuffed in the vessel 102 to reduce the amount of UV light or radiation that reaches the inkjet print heads 118. As shown in FIG. 3B, a light blocking material 202 is stuffed in the vessel 102 to prevent at least a portion of the UV light from the curing lamp 110 from reaching the inkjet print heads 118. However, stuffing the vessel 102 with light block materials can be problematic. For example, stuffing the vessel 102 with light blocking materials can be time consuming and labor intensive. In some instances, the vessel 102 may have a geometry that prevents light blocking materials from being inserted and/or removed (e.g., small necked bottles). As such, an apparatus for curing ink on transparent objects/vessels that also prevents UV light from impinging upon the inkjet print heads 118 without having to insert a light blocking material into the objects/vessels is needed.

Accordingly, an improved printer system and method for hollow vessel printing is provided herein. In at least one embodiment, the printer system includes a pinning lamp configured to pin ink printed on the vessel surface prior to being fully cured by the curing lamp. In some examples, by using the pinning lamp to pin ink printed on the vessel surface, the curing lamp may be kept off until the printing process has completed and/or the vessel has been moved away from the print heads. In addition, the pinning lamp is positioned such that UV light is reflected away from the print heads to prevent the print heads from becoming clogged and/or damaged, eliminating the need to insert UV blocking materials in the vessel.

Figure 4A:
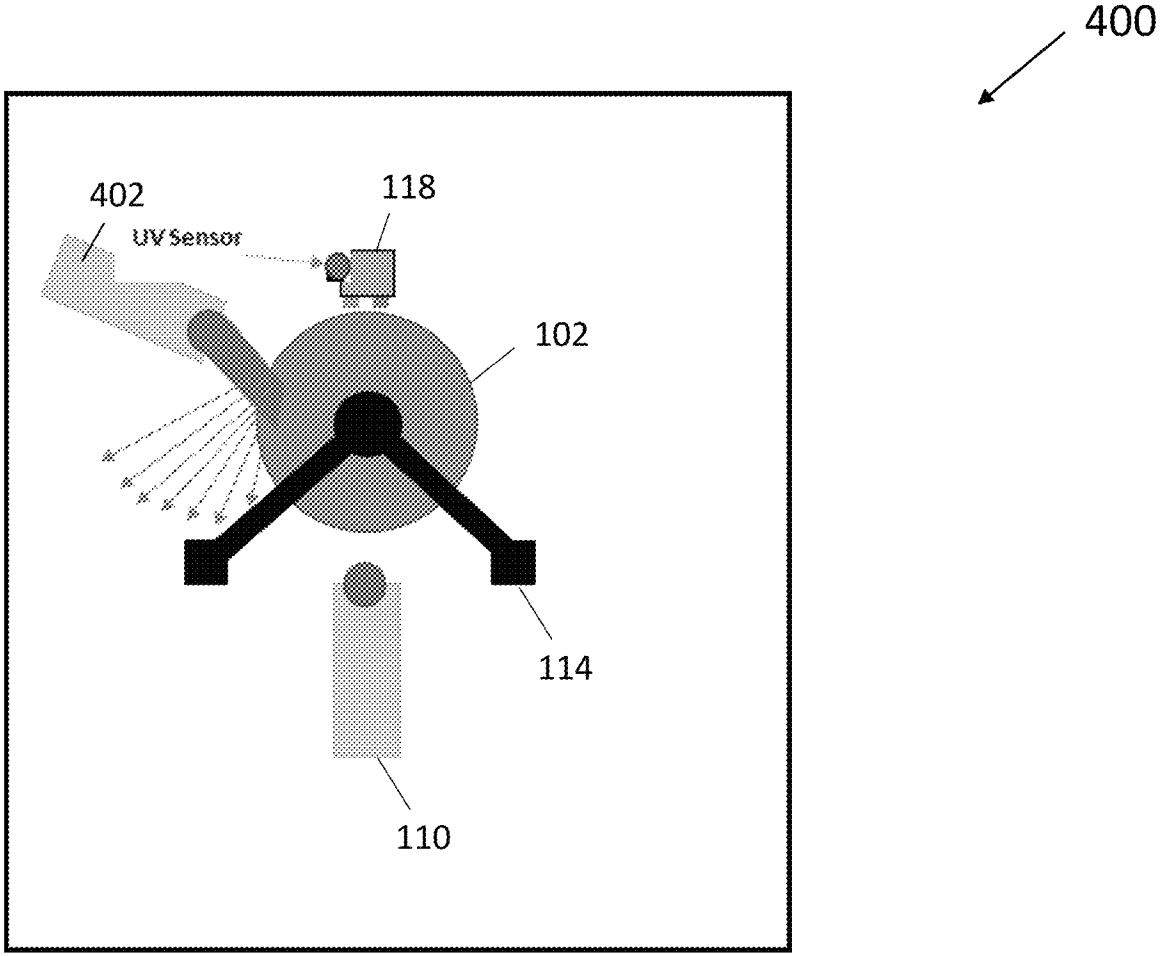
FIG. 4A is a schematic diagram illustrating a single tunnel DTS printer including at least one pinning lamp in accordance with aspects described herein.

FIG. 4A illustrates a schematic diagram of a DTS printer 400 in accordance with aspects described herein. In one example, the DTS printer 400 is similar to the DTS printer 100 of FIGS. 1, 3A, and 3B, except the DTS printer 400 includes a pinning lamp 402.

In some examples, the pinning lamp 402 is configured to provide UV light to sufficiently (at least partially) or fully cure or "pin" ink printed on the surface of the vessel 102. For example, in order to sufficiently (at least partially) or fully cure the ink printed on the surface of the vessel 102, the pinning lamp 402 may provide less power density than the final curing lamp 110. In certain examples, the UV light provided by the pinning lamp 402 may have a nominal wavelength of 375, 385, or 395 nanometers; however, in other examples, the pinning lamp 402 may be configured to provide UV light having different wavelengths.

In one example, the pinning lamp 402 is fixed to carriage tunnel assembly 102 and configured to have the vessel move past the pinning lamp and the print heads during imaging. In some examples, the pinning lamp 402 may be attached to carriage assembly 114 via an adjustable mount or bracket such that the position or angle of the pinning lamp 402 can be adjusted as needed. The pinning lamp mount or bracket may include gradations or markings indicating predetermined positions to guide a user in adjusting the pinning lamp 402. In other examples, the pinning lamp 402 may be attached to a different component of the DTS printer 400 (e.g., the carriage tunnel 104, carriage rails 112*a*, 112*b*, etc.).

As shown in FIG. 4A, the pinning lamp 402 is positioned such that a majority of the UV light (i.e., radiation) provided by the pinning lamp 402 reaches the surface of the vessel 102 and is reflected away from the inkjet print heads 118. In one example, the incident and refraction angles of UV light corresponding to the position of the pinning lamp 402 are given by Snell's Law, shown in equation (1) below:

$$n1 \sin \theta_1 = n2 \sin \theta_2 \tag{1}$$

where, n1 is the index of refraction of the air between the pinning lamp 402 and the vessel 102, n2 is the index of refraction of the vessel 102, $\theta_1$ is the incident angle, and $\theta_2$ is the refraction angle. As such, the relationship between the incident angle $\theta_1$ and the refraction angle $\theta_2$ may vary based on the types of materials of the vessel 102 (e.g., plastic, glass, etc.).

In some examples, to ensure that a majority of the UV light provided by the pinning lamp 402 is reflected away from the inkjet print heads 118, the pinning lamp 402 may be positioned such that the incident angle $\theta_1$ is less than a critical angle associated with the air/vessel interface. In one example, the critical angle is represented by equation (2) below:

$$\theta_c = \sin^{-1}\left(\frac{n1}{n2}\right) \tag{2}$$

where, n1 is the index of refraction of the air between the pinning lamp 402 and the vessel 102, n2 is the index of refraction of the vessel 102, and $\theta_c$ is the critical angle.

Similar to the incident angle $\theta_1$ and the refraction angle $\theta_2$, the critical angle $\theta_c$ also varies based on the material of the vessel 102. For example, the index of refraction n2 for a glass vessel may be 1.52, corresponding to a critical angle $\theta_c$ of 41 degrees. As such, the pinning lamp 402 can be positioned to provide an incident angle $\theta_1$ that is less than 41 degrees to ensure that a majority of the UV light from the pinning lamp 402 is reflected off the vessel 102 away from the inkjet print heads 118. Likewise, the index of refraction n2 for a plastic vessel (e.g., polypropylene) may be 1.50, corresponding to a critical angle $\theta_c$ of 42 degrees. As such, the pinning lamp 402 can be positioned to provide an incident angle $\theta_1$ that is less than 42 degrees to ensure that a majority of the UV light from the pinning lamp 402 is reflected off the vessel 102 away from the inkjet print heads 118.

In some examples, the position of the pinning lamp 402 can be dynamically adjusted (e.g., manually or automatically) such that the incident angle $\theta_1$ is less than the critical angle $\theta_c$ for the type of vessel material being used. In other examples, the pinning lamp 402 may be positioned to provide an incident angle $\theta_1$ optimized for multiple vessel materials. For example, the pinning lamp 402 may be positioned to provide an incident angle $\theta_1$ that is sufficient for both glass and plastic material printing (e.g., 40 degrees). According to some aspects and embodiment, the incidence angle of the pinning lamp is also a function of the packaging of the pinning lamp used. The curing irradiance is emitted at an angle relative to the lamp packaging which affects the incident angle on the vessel.

As described above, the pinning lamp 402 is utilized to sufficiently (at least partially) or fully cure ink printed on the surface of the vessel 102. As such, the deposited ink can be pinned on the surface of the vessel 102, allowing the curing lamp 110 to remain turned off until the vessel 102 has been moved away from the inkjet print heads 118 (e.g., via the linear drive assembly 108).

Figure 4B:
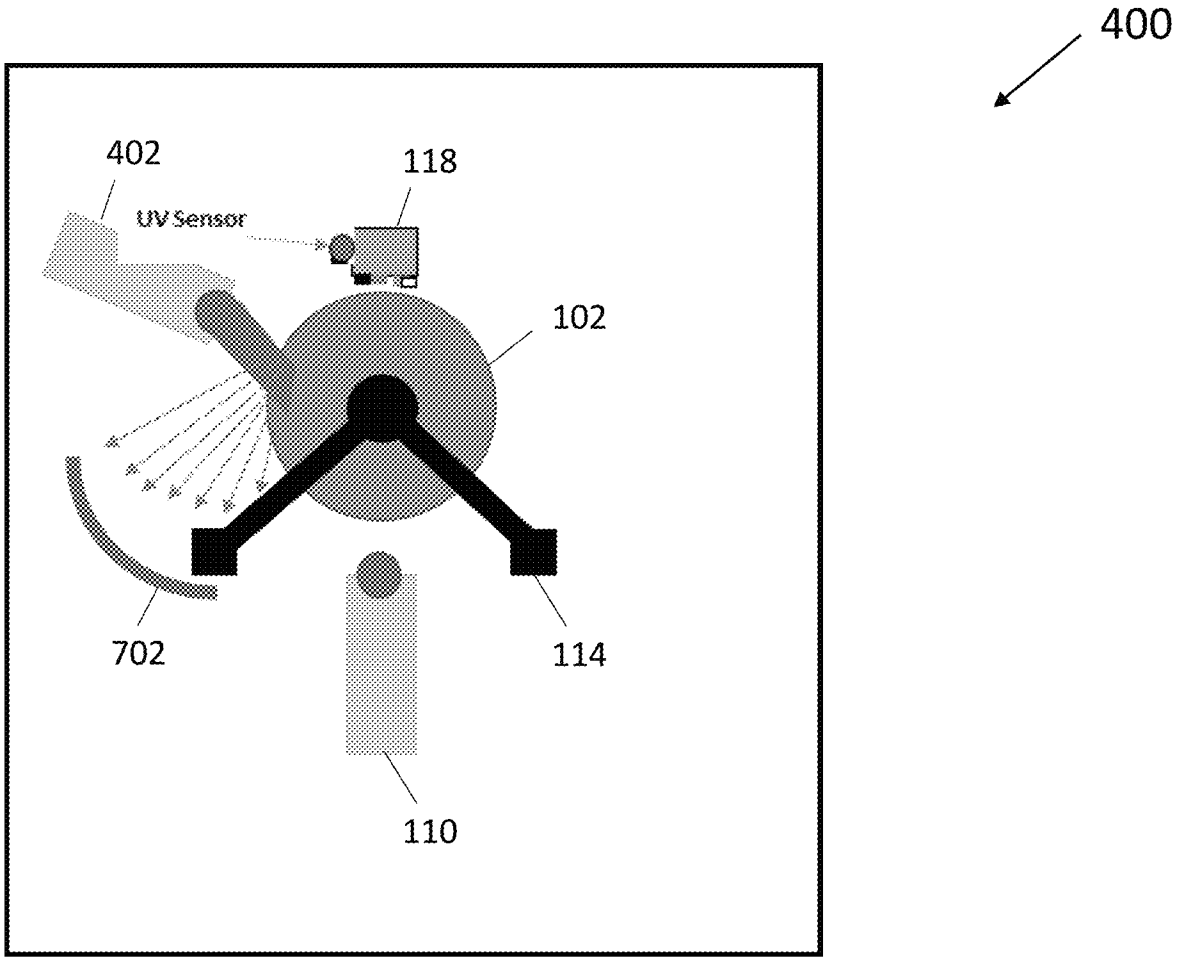
FIG. 4B is a schematic diagram illustrating a DTS printer including a light trap in accordance with aspects described herein.

Referring to FIG. 4B, in some examples, to further prevent UV light from reaching the inkjet printheads 118, a light trap can be positioned within the DTS printer 400. For example, as shown in FIG. 4B, a light trap 702 is positioned to "trap" or absorb UV light that is reflected off the vessel 102 from the pinning lamp 402. In one example, the light trap 702 is a non-reflective sheet or guard configured to absorb or dampen UV light. The light trap 702 may be positioned to prevent UV light from reflecting off components of the DTS printer 400 back towards the inkjet print heads 118. In some examples, the light trap 702 is attached to the carriage rail assembly 114 and configured to move with the vessel 102 during printing; however, in other examples, the light trap 702 may be stationary and attached to one of the carriage tunnels 104, the carriage rails 112*a*, 112*b*, or a different component of the DTS printer 400.

Referring to FIGS. 4A-4B, aspects and embodiments of the system include a UV sensor that is located near the print head nozzles and print head channels. The UV sensor senses the amount of light exposure from the pinning lamp(s) and provides sensed amount of light information to a controller that is used to control the amount of light output from the pinning lamp(s) to ensure any or all of alignment of the pinning lamp(s) with the vessel geometry, and to ensure that the level of emitted light does not result in radiation levels high enough to cure ink in the print head nozzles, so as to avoid damage to the print head and/or a degraded image quality.

Figure 4C:
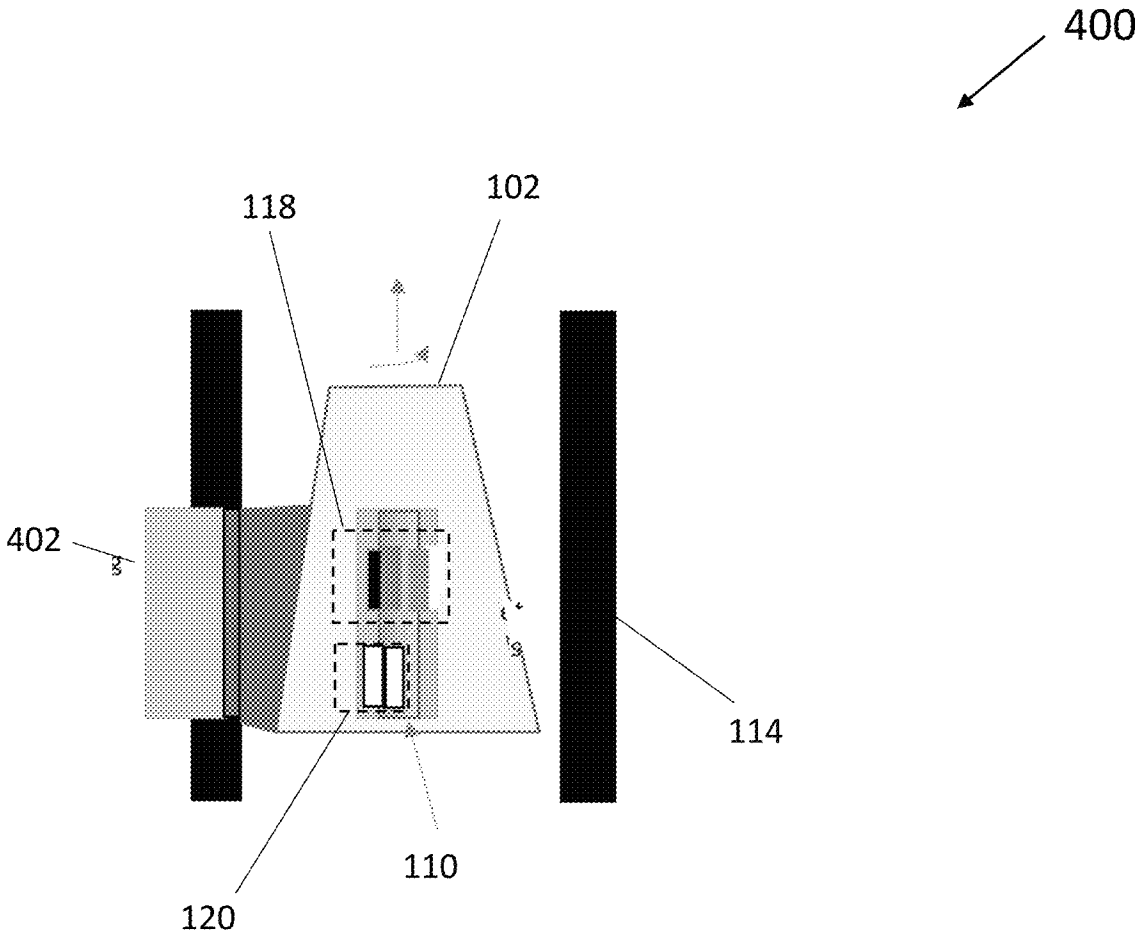
FIG. 4C is a schematic diagram illustrating a DTS printer including at least one pinning lamp in accordance with aspects described herein.

FIG. 4C illustrates an overhead view of the DTS printer 400. As shown, the inkjet print heads 118 are configured to deposit ink on the surface of the vessel 102 while the vessel 102 is rotated (via the rotary drive assembly 106) and moved along the carriage rails 112*a*, 122*b* (via the carriage rail assembly 114). As the vessel 102 is rotated/moved, the pinning lamp 402 partially cures the ink deposited on the surface of the vessel 102. In one example, the ink is sufficiently (at least partially) or fully cured such that the position of the ink is maintained until the entire image or image layer has been deposited. As such, the final curing lamp 110 can remain turned off until the vessel 102 is moved away from the inkjet print heads 118 (e.g., to a loading position). Once the vessel 102 has been moved away from the inkjet print heads 118, the curing lamp 110 can be turned on (i.e., illuminated) to fully cure the ink deposited on the surface of the vessel 102 without the risk of UV light reaching the inkjet print heads 118. After the ink has been fully cured, the curing lamp 110 can be turned back off, and the vessel 102 may be moved back towards the inkjet print heads 118 for further printing (e.g., additional layers) or removed from the DTS printer 400.

In some examples, in order to account for variations in the surface of the vessel 102 (e.g., tapers, curves, etc.), the pinning lamp 402 may provide UV light with minimal power density variations over distance. For example, the pinning lamp 402 may be configured to provide a substantially constant power density at various distances between the pinning lamp 402 and the surface of the vessel 102. In certain examples, the pinning lamp 402 may be configured with a specialized lens designed to provide constant power density by reducing peak radiation. In one example, the pinning lamp 402 may be a UDOS UV LED module manufactured by Ushio of Tokyo, Japan. However, in other examples, any other type of appropriate lamp may be utilized.

According to aspect and embodiments, it is noted that the pinning lamp configuration can be comprised of a single lamp or multiple lamps mechanically aligned in series or in parallel. With multiple pinning lamps, lower irradiance levels can be used while maintaining the total curing dose and more rows of similar or longer print heads can be supported, and with the ability to independently control each lamp. Given this, it is possible to optimize the balance of pin curing dose on the vessel while limiting the exposure to the printheads due to reflections or stray light.

Figure 4D:
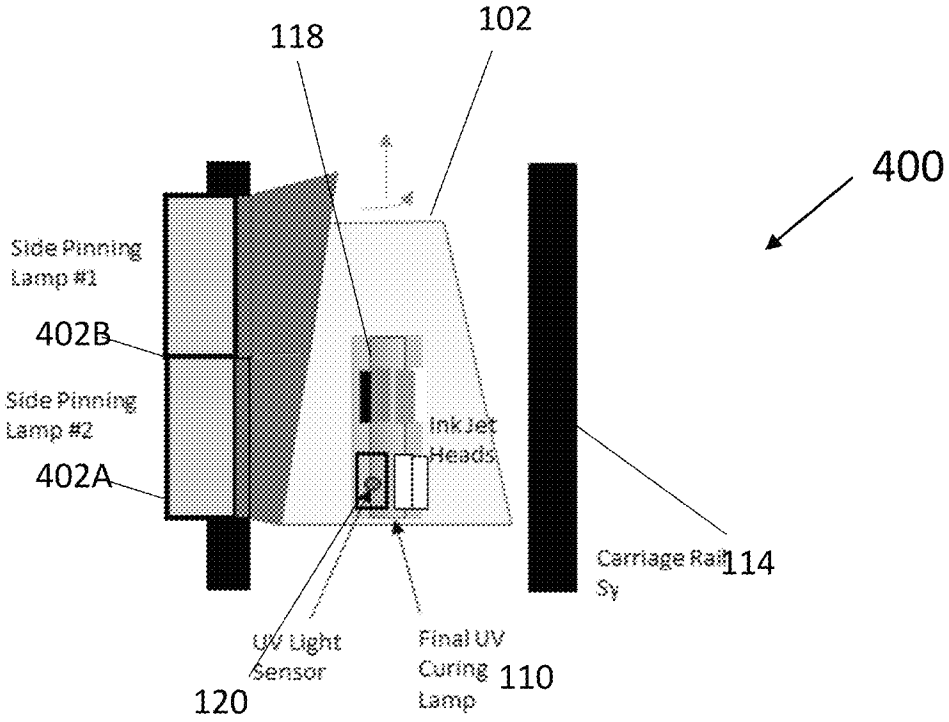
FIG. 4D is a schematic diagram illustrating a DTS printer including two pinning lamps in series in accordance with aspects described herein.

FIG. 4D illustrates an overhead view of another embodiment of the DTS printer 400. This embodiment includes two pinning lamps 402A, 402B arranged in series. Like reference numbers correspond to like structure and for the sake of brevity a description of all of the elements may not be repeated. As shown, the inkjet print heads 118 are configured to deposit ink on the surface of the vessel 102 while the vessel 102 is rotated (via the rotary drive assembly 106) and moved along the carriage rails 112*a*, 122*b* (via the carriage rail assembly 114). As the vessel 102 is rotated/moved, the pinning lamps 402A, 402B sufficiently (at least partially) or fully cures the ink deposited on the surface of the vessel 102. In one example, the ink is sufficiently (at least partially) or fully cured by pinning lamps 402A, 402B such that the position of the ink is maintained until the entire image or image layer has been deposited. As such, the final curing lamp 110 can remain turned off until the vessel 102 is moved away from the inkjet print heads 118 (e.g., to a loading position). Once the vessel 102 has been moved away from the inkjet print heads 118, the curing lamp 110 can be turned on (i.e., illuminated) to fully cure the ink deposited on the surface of the vessel 102 without the risk of UV light reaching the inkjet print heads 118. After the ink has been fully cured, the curing lamp 110 can be turned back off, and the vessel 102 may be moved back towards the inkjet print heads 118 for further printing (e.g., additional layers) or removed from the DTS printer 400.

It is appreciated that various aspects or embodiments can comprise two or more pinning lamps, arranged either in series as illustrated in FIG. 4B, in a parallel arrangement one on each side of the vessel to be cured (not illustrated), or in both a series and parallel arrangement, such as for example four pinning lamps, two in series on each of the vessel to be cured (not illustrated).

According to aspects and embodiments, the printer and method includes providing the pinning light having the first peak power density at a substantially constant level over an operational distance range. In some embodiments, the method includes positioning the at least one pinning lamp such that a maximum working distance between the at least one pinning lamp and the surface of the vessel is within the operational distance range of the at least one pinning lamp, and wherein the maximum working distance corresponds to the position of the at least one pinning lamp and a shape of the vessel. In some embodiments, the method includes aligning an axis of the at least one pinning lamp with a rotational axis of a tapered vessel to ensure a sufficient amount of radiation is provided to the vessel.

In some examples, in order to account for variations in the surface of the vessel 102 (e.g., tapers, curves, etc.), the pinning lamps 402A, 402B may provide UV light with minimal power density variations over distance. For example, the pinning lamps 402A, 402B may be configured to provide a substantially constant power density at various distances between the pinning lamps 402A, 402B and the surface of the vessel 102. In certain examples, the pinning lamps 402A, 402B may be configured with a specialized lens designed to provide constant power density by reducing peak radiation. In one example, the pinning lamps 402A, 402B may be a UDOS UV LED module manufactured by Ushio of Tokyo, Japan. However, in other examples, any other type of appropriate lamp may be utilized.

As previously noted, the DTS printer is configured to print various shapes, such as cylinders and vessels having tapers (such as a pint glass, wine bottles and the like). It is appreciated that the surface of the vessel to be printed must be close to the print heads. However, the diameter of the surface of the vessel to be printed can vary over the length of the vessel. The DTS printer is configured so that the rotational axis of the vessel to be printed is raised for smaller diameters of the vessel to be printed and lowered as the diameter of the vessel increases. In particular, when printing a taper on the vessel, the vessel to be printed is tilted so that the tapered wall of the glass is parallel to the ink jet head plate, ensuring the ink jet head height is always minimized relative to the printing surface. For example, if there is a 7 degree taper angle of the vessel, the vessel is tilted 7 degrees to level the printed surface (to be parallel to the ink jet head plate). With this arrangement, the pinning lamp(s) location can be fixed.

Aspects and embodiments are directed to determining how the midway point of the cross section the vessel being printed moves with the top of the vessel being fixed relative to the print heads and as the diameter of the vessel being printed gets larger and/or smaller. Aspects and embodiments are directed to adjusting the angle of the pinning lamp(s) (either manually or automatically) so as to be parallel to the vessel rotational axis to normalize the pinning lamp curing radiation over the length of a taper of the vessel. Aspects and embodiments are directed to determining and adjusting the radiation angle of the light emitted by the pinning lamp(s) to adjust the incident angle of the light from the pinning lamp(s) on the vessel (with a varying diameter) being printed. In particular, aspects and embodiments are directed to adjusting (either manually or automatically) the radial position of the pinning lamp(s) along an arc and the axial angle of the lamp(s) mounting bracket to adjust the incident radiation on the vessel with varied diameters of the vessel. In addition, aspects and embodiments are directed to the lamp mounting system that retains the radiation incident angle and radial positioning of the pinning light on the vessel over the range of diameters of the vessel being printed.

Aspects and embodiments are directed to bracket that is constructed and arranged for holding and adjusting the pinning lamps to be able to adjust an angle of irradiation by the pinning lamps. The bracket is configured to have an adjustable angle that is a function of any or all of: the light radiation angle leaving the pinning lamp; the midway point of the vessel to be printed as it moves with the top of the vessel fixed relative to the print heads; and/or the diameter of the vessel to be printed as it varies. In particular, the bracket is constructed and arranged to vary the angle of the incident radiation emitted by the pinning lamp on the vessel with varied vessel diameters so as to match an adjustment arc of the lamp mounting bracket. In other words, a slope of movement of the pinning lamp mounting bracket provides for adjustment (automatically or manually) of the pinning lamp radiation for irradiating the midpoint (equator) of the vessel for vessels of different diameters.

Figure 8:
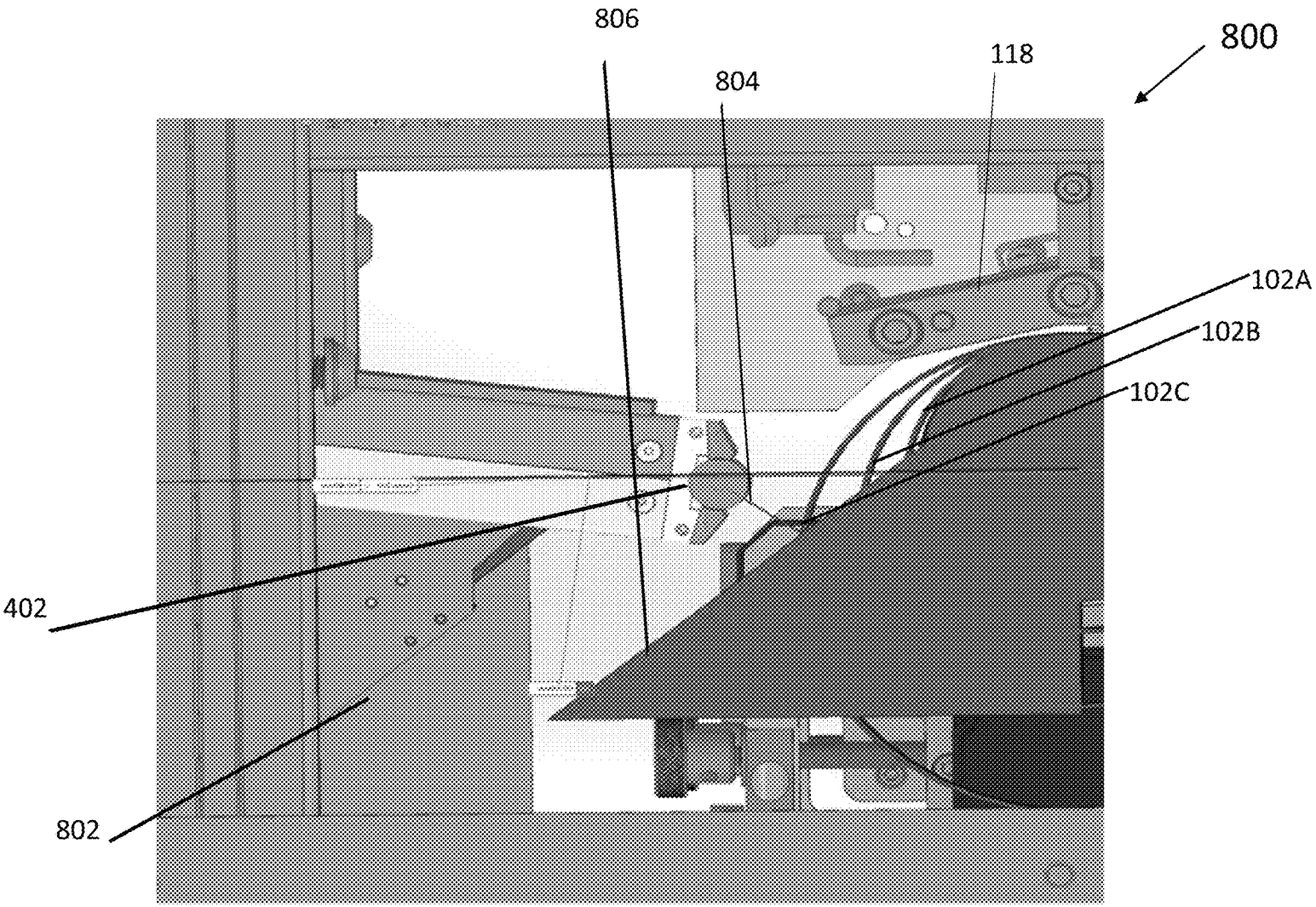
FIG. 8 illustrates an example of a direct-to-shape (DTS) printer in accordance with aspects described herein including an adjustment bracket for at least one pinning lamp arrangement.

Referring to FIG. 8, there is illustrated an example of a direct-to-shape (DTS) printer 800 in accordance with aspects described herein including an adjustment bracket for at least one pinning lamp arrangement. It is appreciated that like reference numbers correspond to like structure and for the sake of brevity a description of all of the elements is not be repeated. In FIG. 8, a slope of angle of the adjustment of the bracket for adjusting an angle of irradiation 804 by the pinning lamps is shown as the linear incline 802. In particular, the slope of the linear incline 802 for angle of adjustment of the mounting bracket and for the pinning lamp positioning is configured to accommodate the midpoint of the vessel decreasing with increasing diameters of the vessel (as illustrated by semicircular arcs 102A, 102B, 102C) and so that the pinning lamp 402 moves away from the reduced center rotational point, which results in a linear slope 806 of irradiation by the pinning lamp as a function of the vessel cross section. In particular, an optimum location and angle of the pinning lamp along the slope 802 to provide a linear slope of irradiation 806 is determined to accommodate all radiuses of the vessel and is set and secured. This can be positioned and secured manually, for example by any securing mechanism know to one of skill in the art such as, for example, a thumb screw. For example, the bracket assembly including the pining lamp is moved up and down the linear slope 802 and a thumb screw is used to fix the bracket position.

Figure 5:
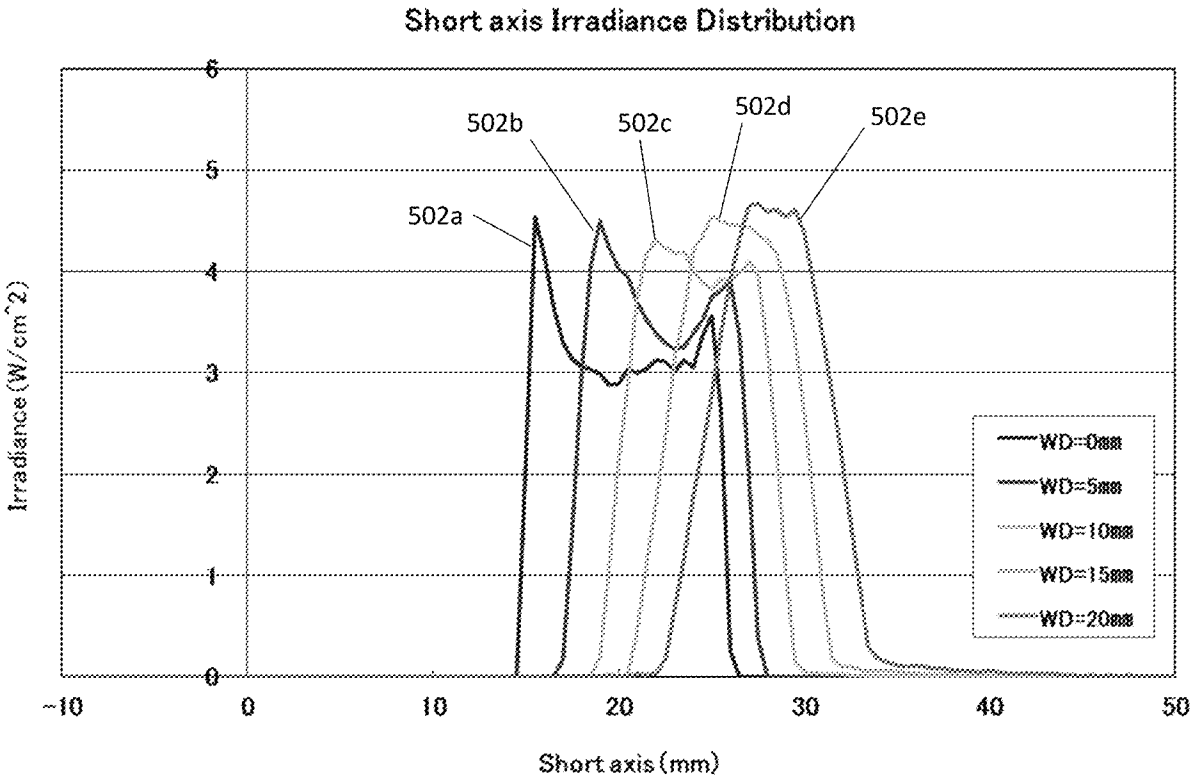
FIG. 5 is a graph illustrating power density data from at least one pinning lamp in accordance with aspects described herein.

Aspects and embodiments are directed to configuring the pin curing lamp(s) with a peak energy density radiation that does not vary greatly with working distance from the printed surface of the vessel. This allows tapered drinkware and/or curved vessels to be printed without a great variation in pinning lamp curing dose. FIG. 5 illustrates the peak power density of the pinning lamp 402 as a function of working distance (i.e., the distance between the pinning lamp 402 and the surface of the vessel 102). In one example, a first power density trace 502*a* corresponds to a working distance of 0 mm, a second power density trace 502*b* corresponds to a working distance of 5 mm, a third power density trace 502*c* corresponds to a working distance of 10 mm, a fourth power density trace 502*d* corresponds to a working distance of 15 mm, and a fifth power density trace 502*e* corresponds to a working distance of 20 mm. As shown, the peak power density is substantially constant over the various working distances. In other words, as the surface of the vessel 102 moves farther away from the pinning lamp 402, the peak (and total) energy density at the surface of the vessel 102 remains constant. Being that the peak power density remains constant over various working distances, the pinning lamp 402 can provide a consistent amount of radiation (i.e., UV light) to the surface of the vessel 102 while accounting for different surface variations (e.g., tapers, curves, bends, etc.).

In addition to positioning the pinning lamp 402 to provide an optimized incident angle $\theta_1$, the position of the pinning lamp 402 can be adjusted to provide a desired working distance range with respect to the vessel 102. For example, the pinning lamp 402 may be positioned such that the maximum working distance for a given vessel type (e.g., long neck bottle) is within a desired operating range of the pinning lamp 402 (e.g., 0 to 20 mm). In certain examples, the desired operating range of the pinning lamp 402 may vary based on the wavelength of the UV light provided by the pinning lamp 402.

Figure 6A:
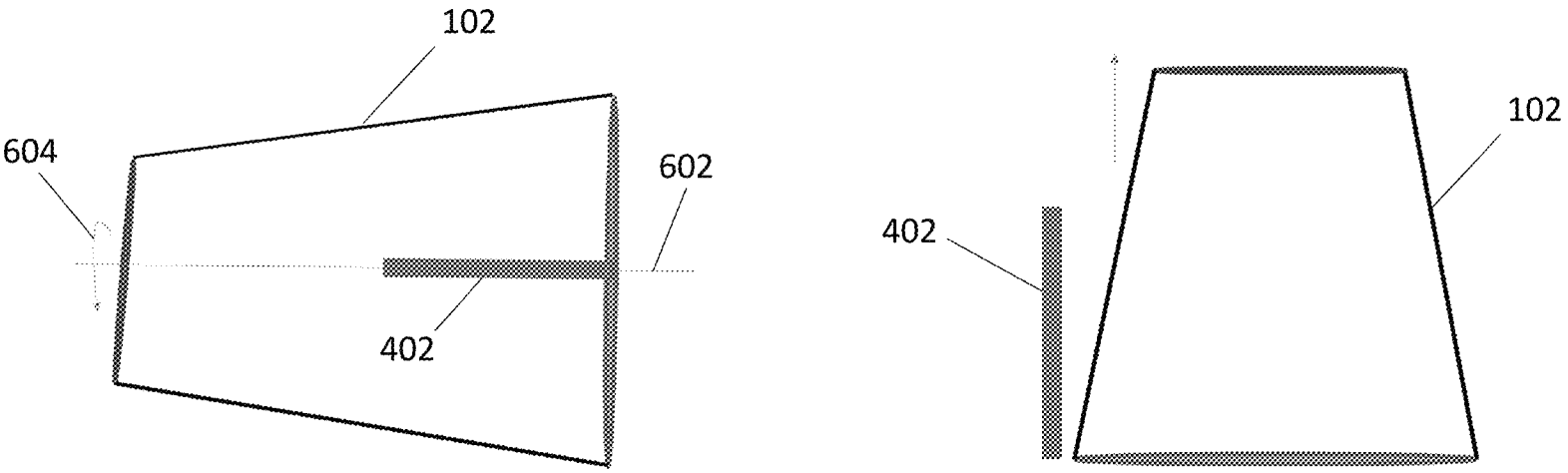
FIG. 6A is a diagram illustrating multiple perspective views of a pinning lamp arranged with respect to a vessel in accordance with aspects described herein.
Figure 6B:
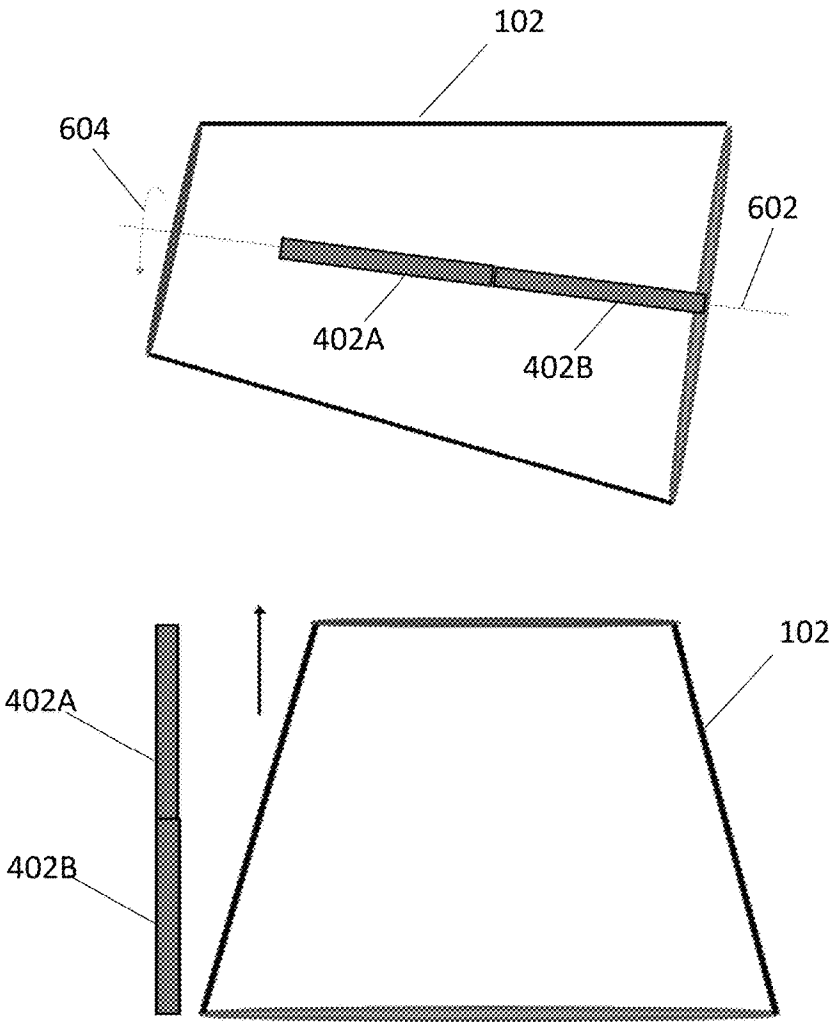
FIG. 6B is a diagram illustrating multiple views of an embodiment with two pinning lamps arranged with respect to a vessel in accordance with aspects described herein.
Figure 6C:
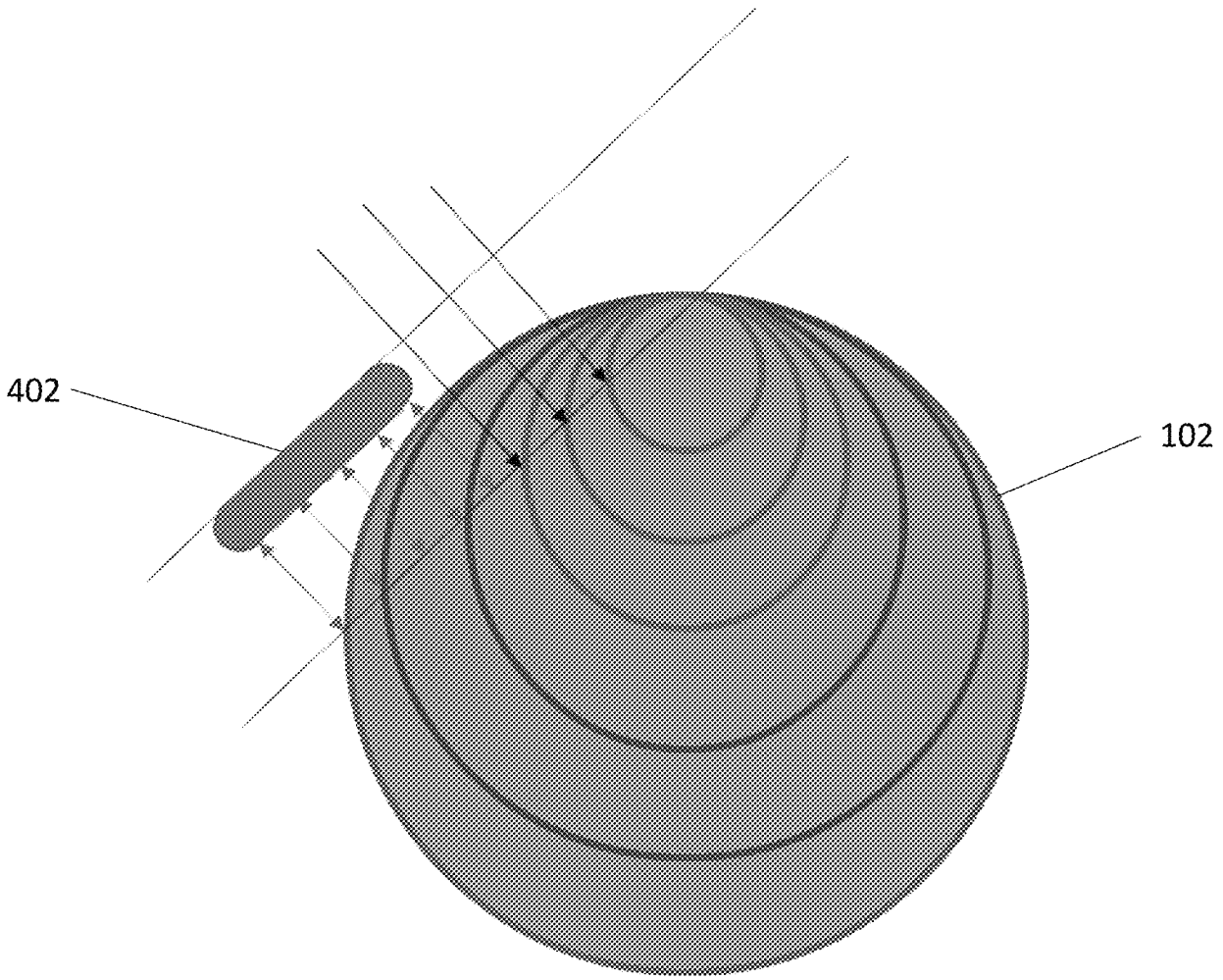
FIG. 6C is a diagram illustrating a perspective view of a pinning lamp with respect to a vessel in accordance with aspects described herein.

FIG. 6A illustrates multiple views of a pinning lamp 402 with respect to the vessel 102. In some examples the pinning lamp 402 may be positioned in parallel to a motion axis 602 and/or a rotational axis 604. In one example, the motion axis 602 corresponds to the axis that the linear drive assembly 108 is configured to move the carriage rail assembly 114 (i.e., the vessel 102) along. Likewise, the rotational axis 604 corresponds to the axis of rotation that the rotary drive assembly 106 is configured to rotate the vessel 102 about (via the mandrel 116). FIG. 6B illustrates multiple views of two pinning lamps 402A, 402B configured and arranged with respect to the vessel 102. In some examples the two pinning lamps 402A, 402B may be positioned in series or in parallel to a motion axis 602 and/or a rotational axis 604. In one example, the motion axis 602 corresponds to the axis that the linear drive assembly 108 is configured to move the carriage rail assembly 114 (i.e., the vessel 102) along. Likewise, the rotational axis 604 corresponds to the axis of rotation that the rotary drive assembly 106 is configured to rotate the vessel 102 about (via the mandrel 116). As shown in FIG. 6C, the pinning lamp 402 or the pinning lamps 402A, 402B may be positioned in parallel to the motion axis 602 and/or the rotational axis 604 such that the pinning lamp(s) 402 clears the maximum diameter of the vessel 102. By positioning the pinning lamp(s) 402 in parallel with the rotational axis 604, the pinning lamp(s) 402 can provide a sufficient amount of radiation at both the minimum and maximum diameters of the vessel 102.

Figure 7:
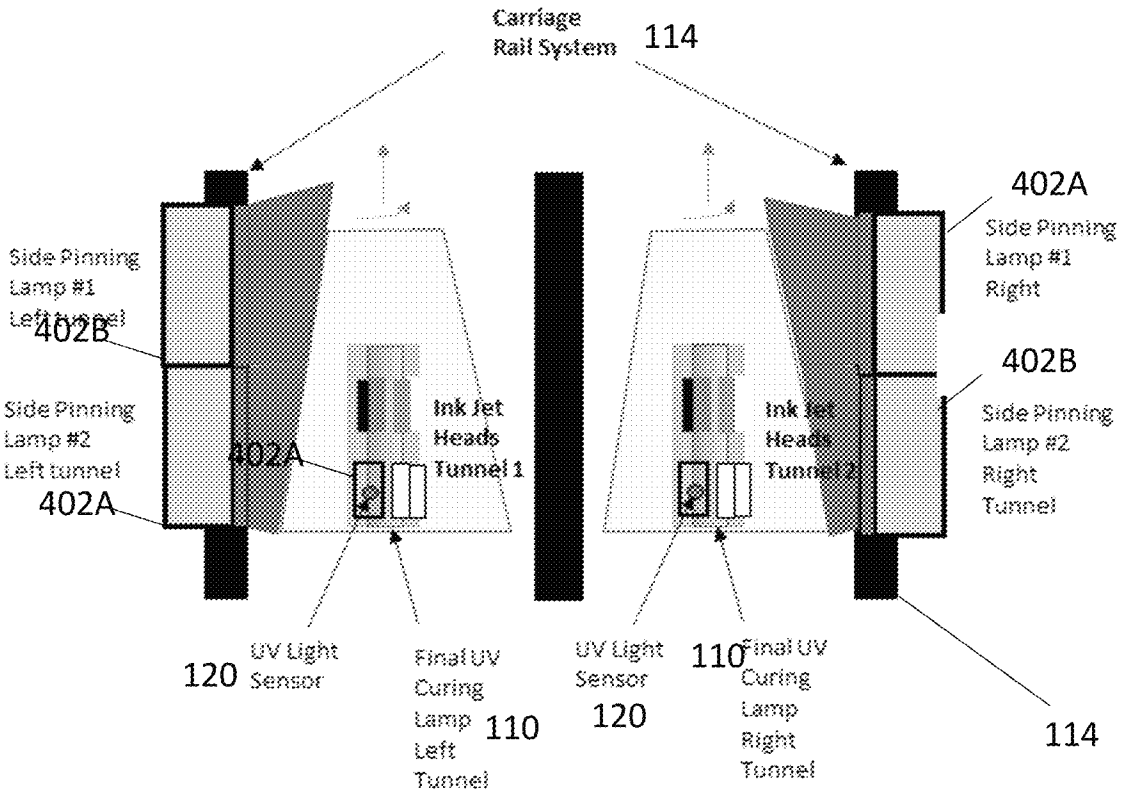
FIG. 7 is a schematic diagram illustrating a multiple tunnel DTS printer including two pinning lamps in accordance with aspects described herein.

Additional aspects and embodiments of the disclosure include that the various embodiments disclosed herein, including the various pinning lamp assemblies, can be applied to high throughput DTS machines providing multiple, in parallel, imaging tunnels comprising two or more jetting paths. Such devices provide higher productivity than a single jetting tunnel. For example, FIG. 7 is a schematic diagram illustrating a multiple tunnel DTS printer with each tunnel including two pinning lamps in accordance with aspects described herein. It is appreciated that any of the aspects, embodiments and features disclosed herein can be applied to multiple tunnel printer. For the sake of brevity, it is understood that like reference numbers correspond to like structure as already described herein and for the sake of brevity a description of all of the elements is not be repeated.

While not shown, it should also be appreciated that the pinning lamp 402 or plurality of pinning lamps 402A, 402B can be included and positioned in other known or different printer configurations, such as multiple printing tunnel machines and other DTS printers. For example, the pinning lamp 402 or plurality of pinning lamps 402A, 402B may be included and positioned as described above in a DTS printer similar to the DTS printer 200 of FIG. 2. In one example, the pinning lamp 402 or plurality of pinning lamps 402A, 402B can be positioned such that the UV light provided by the pinning lamp 402 or plurality of pinning lamps 402A, 402B is reflected off the vessel 102 away from the inkjet print heads 218 of the DTS printer 200.

Aspects and embodiments include two pinning lamps which can be, for example, in series to perform sufficient (at least partial) curing of ink on the vessel surface. One advantage of having two or more pinning lamps is that the two or more pinning lamps can be configured and controlled separately to provide less peak output power than a single pinning lamp arrangement, and to provide the total dose of light (power*time) to sufficiently (at least partially) cure the ink while also providing for less peak light being provided to the print heads so as to avoid any curing ink in the print heads. With this arrangement and the capability to independently control each pinning lamp's curing dose on the vessel, it is possible to optimize the balance of light provided while also limiting the exposure to the printheads due to reflections or stray light.

Aspects and embodiments include multiple pinning lamps mechanically aligned in parallel. With multiple pinning lamps, each pinning lamp is configured and to be controlled separately to provide lower peak irradiance power than a single pinning lamp arrangement, to provide for the total dose of light (power*time) to sufficiently (at least partially) cure the ink while also providing for less light amplitude being provided to the print heads so as to avoid any curing ink in the print heads. With this arrangement multiple rows of similar or longer print heads can be supported. With this arrangement and the capability to independently control each pinning lamp curing dose on the vessel, it is possible to optimize the balance of light provided while also limiting the exposure to the printheads due to reflections or stray light.

Aspects and embodiments include sufficiently curing ink printed on the vessel with at least one pinning lamp or a plurality (two or more) pinning lamps such that the printed image on the vessel can be coated with a varnish without affecting the printed image. In particular, after the image has been printed with the ink colors (i.e., white, cyan, magenta, yellow, and black) on the vessel, the image is sufficiently cured by the pinning lamp(s), and then the image is sometimes coated with a varnish. Aspects and embodiments of the system and method include curing the printed image with the pinning lamp(s) sufficiently or fully so that the varnish doesn't affect the printed image. In contrast, it has been determined that if the printed image is not sufficiently cured and the varnish is jetted onto an uncured image, a pitted, undesirable finish results. Given this, aspects and embodiments of the system and method are configured to sufficiently (at least partially) or fully cure the ink such that coating the image with the varnish does not affect the printed image.

Aspects and embodiments of the system include a final curing lamp that is located and/or configured such that radiation from the final curing lamp doesn't reach any of the print heads and/or such that the final curing lamp is not enabled at a time that light from the curing lamp can expose the print heads, such print heads are moved away from the final curing lamps, so that the print heads are not exposed to the final curing light. Aspects and embodiments of the system include a fixed rotating vessel with a print head carriage that moves along the axis of the vessel. With this arrangement, the pinning lamp is located and arranged to move with the ink jet carriage to irradiate the vessel to sufficiently (at least partially cure) an image printed on the vessel. With this arrangement, the final curing lamp can be fixed relative to the printed surface on the rotating vessel.

As described above, an improved printer system and method for hollow vessel printing is provided herein. In at least one embodiment, the printer system includes at least one or more pinning lamps configured to pin ink printed on the vessel surface prior to being fully cured by the curing lamp. In some examples, by using the pinning lamp(s) to pin ink printed on the vessel surface, the final curing lamp may be kept off until the printing process has completed and/or the vessel has been moved away from the print heads. In addition, the at least one pinning lamp is positioned such that UV light is reflected away from the print heads to prevent the print heads from becoming clogged and/or damaged, eliminating the need to insert UV blocking materials in the vessel.

Having described above several aspects of at least one embodiment, it is to be appreciated various alterations, modifications, and improvements will readily occur to those skilled in the art. Such alterations, modifications, and improvements are intended to be part of this disclosure and are intended to be within the scope of the disclosure. Accordingly, the foregoing description and drawings are by way of example only, and the scope of the disclosure should be determined from proper construction of the appended claims, and their equivalents.

What is claimed is:

1. A direct to shape (DTS) printer configured to print on a surface of a vessel, the DTS printer comprising:

a plurality of inkjet print head channels configured to deposit ink on the surface of the vessel;

a rotary drive assembly configured to rotate the vessel relative to the plurality of inkjet print head channels;

at least one pinning lamp configured to provide light having a first peak power density to sufficiently cure the ink deposited on the surface of the vessel; and a final curing lamp that is separately located and distinct from the at least one pinning lamp, and that is configured to provide light having a second peak power density to fully cure the ink deposited on the surface of the vessel.

2. The DTS printer of claim 1, wherein the second peak power density is greater than the first peak power density.

3. The DTS printer of claim 1, wherein the at least one pinning lamps includes multiple pinning lamps in series or in parallel, each pinning lamp configured and controlled separately to provide a respective output power that is less than the first peak power density and to provide a total amount of light that at the first peak power density that includes the respective output power levels over a period of time to sufficiently cure the ink.

4. The DTS printer of claim 3, wherein the multiple pinning lamps includes two pinning lamps in series.

5. The DTS printer of claim 1, further comprising a linear drive assembly configured to move the vessel along an axis adjacent to the plurality of inkjet print head channels.

6. The DTS printer of claim 1, wherein the rotary drive assembly is a fixed rotating assembly and further comprising a print head carriage assembly that moves along the axis of the vessel so as to print the image on the vessel.

7. The DTS printer of claim 6, wherein the pinning lamp is configured and arranged to move with the print head carriage assembly to irradiate the vessel to sufficiently cure an image printed on the vessel.

8. The DTS printer of claim 1, wherein the pinning lamp is configured to sufficiently cure the ink printed image on the vessel such that the printed image on the vessel can be coated with a varnish without affecting the printed image.

9. The DTS printer of claim 1, wherein the pinning lamp is configured to fully cure the ink deposited on the surface of the vessel.

10. The DTS printer of claim 1, wherein the final curing lamp is configured to be off until the vessel is moved away from the plurality of inkjet print head channels.

11. The DTS printer of claim 1, further comprising a UV sensor that is located near the print head channels, that is configured to sense an amount of light exposure from the at least one pinning lamp, and that provides sensed amount of light information to a controller that is configured to control the amount of light output from the at least one pinning lamp to ensure that the level of emitted light from the at least one pinning lamp does not result in radiation levels high enough to cure ink in the print head channels.

12. The DTS printer of claim 1, wherein the pinning lamp is positioned to emit light that is not perpendicular to the vessel and to the plurality of inkjet print head channels such that the light provided by the pinning lamp is reflected off the surface of the vessel away from the plurality of inkjet print head channels.

13. The DTS printer of claim 12, wherein the pinning lamp is positioned to provide light to the surface of the vessel at an incident angle that is less than a critical angle corresponding to a material of the vessel.

14. The DTS printer of claim 12, further comprising a light trap configured to absorb or dampen the light reflected off the surface of the vessel.

15. The DTS printer of claim 1, wherein the pinning lamp is configured to provide the light having the first peak power density at a substantially constant level over an operational distance range.

16. The DTS printer of claim 15, wherein the position of the pinning lamp is configured to be adjusted such that a maximum working distance between the pinning lamp and the surface of the vessel is within the operational distance range of the pinning lamp, and wherein the maximum working distance corresponds to the position of the pinning lamp and a shape of the vessel.

* * * * *